US010175608B2

(12) United States Patent
Tamaki et al.

(10) Patent No.: US 10,175,608 B2
(45) Date of Patent: Jan. 8, 2019

(54) DEVELOPING DEVICE AND IMAGE FORMING APPARATUS PROVIDED WITH SAME

(71) Applicant: KYOCERA Document Solutions Inc., Osaka-shi, Osaka (JP)

(72) Inventors: Kenichi Tamaki, Osaka (JP); Tamotsu Shimizu, Osaka (JP); Akifumi Yamaguchi, Osaka (JP)

(73) Assignee: Kyocera Document Solutions Inc. (JP)

( * ) Notice: Subject to any disclaimer, the term of this patent is extended or adjusted under 35 U.S.C. 154(b) by 140 days.

(21) Appl. No.: 15/457,063

(22) Filed: Mar. 13, 2017

(65) Prior Publication Data

US 2017/0269510 A1 Sep. 21, 2017

(30) Foreign Application Priority Data

Mar. 17, 2016 (JP) ..... 2016-053847
Mar. 17, 2016 (JP) ..... 2016-053848

(51) Int. Cl.
*G03G 15/08* (2006.01)
*G03G 15/09* (2006.01)

(52) U.S. Cl.
CPC ..... *G03G 15/0889* (2013.01); *G03G 15/0812* (2013.01); *G03G 15/0907* (2013.01)

(58) Field of Classification Search
CPC ..... G03G 15/0889; G03G 15/0812; G03G 15/0907
See application file for complete search history.

(56) References Cited

U.S. PATENT DOCUMENTS

2005/0238390 A1* 10/2005 Fukuda ..... G03G 15/0813 399/267
2007/0053724 A1* 3/2007 Akashi ..... G03G 15/0921 399/269
2011/0222918 A1* 9/2011 Ikeda ..... G03G 15/0812 399/269
2011/0229215 A1* 9/2011 Hirota ..... G03G 15/0935 399/269

(Continued)

FOREIGN PATENT DOCUMENTS

JP 4-107586 4/1992

*Primary Examiner* — G. M. A Hyder
(74) *Attorney, Agent, or Firm* — Gerald E. Hespos; Michael J. Porco; Matthew T. Hespos

(57) ABSTRACT

A developing device includes a developing roller, a conveyor roller and a developer stirring unit. The developing roller is arranged to face a photoconductive drum at a predetermined developing position. The developing roller includes a fixed first magnet and a first sleeve. The conveyor roller is arranged to face the developing roller at a predetermined facing position. The conveyor roller includes a fixed second magnet and a second sleeve. The developer stirring unit stirs the developer and supplies the developer to the conveyor roller. The first magnet includes a first magnetic pole composed of a predetermined magnetic pole and a second magnetic pole arranged downstream of and adjacent to the first magnetic pole and having the same polarity as the first magnetic pole. The developer is transferred from the developing roller to the conveyor roller after passing through a repulsive magnetic field formed by the first and second magnetic poles.

19 Claims, 14 Drawing Sheets

(56) References Cited

U.S. PATENT DOCUMENTS

| | | | | |
|---|---|---|---|---|
| 2012/0051796 | A1* | 3/2012 | Oba | G03G 15/0808 399/272 |
| 2013/0202330 | A1* | 8/2013 | Ochi | G03G 15/0896 399/269 |
| 2013/0236215 | A1* | 9/2013 | Ochi | G03G 15/0189 399/269 |
| 2017/0269509 | A1* | 9/2017 | Shimizu | G03G 15/0921 |

* cited by examiner

DEVELOPING DEVICE AND IMAGE FORMING APPARATUS PROVIDED WITH SAME

This application is based on Japanese Patent Applications Nos. 2016-053847 and 2016-053848 filed with the Japan Patent Office on Mar. 17, 2016, the contents of which are hereby incorporated by reference.

BACKGROUND

The present disclosure relates to a developing device and an image forming apparatus provided with the same.

Conventionally, an electrophotographic image forming apparatus such as a printer or a copier includes a photoconductive drum for carrying an electrostatic latent image, a developing device for developing an electrostatic latent image into a toner image by supplying toner to the photoconductive drum and a transfer device for transferring a toner image from the photoconductive drum to a sheet.

The developing device includes a developing roller for supplying toner to a photoconductive drum and a conveyor roller for supplying developer to the developing roller. Further, each of the developing roller and the conveyor roller includes a fixed magnet having a plurality of magnetic poles and a sleeve configured to rotate around the magnet. The developer is supplied from the conveyor roller to the developing roller by a magnetic force generated between a first S pole on the side of the conveyor roller and a first N pole on the side of the developing roller. Further, the developer is collected from the developing roller to the conveyor roller by a magnetic force generated between a second N pole on the side of the developing roller and a second S pole on the side of the conveyor roller.

The present disclosure aims to suppress the generation of ghosts in a developing device including a plurality of rollers each having a magnet inside and configured to transfer developer to each other and an image forming apparatus provided with this developing device.

SUMMARY

A developing device according to one aspect of the present disclosure includes a developing roller, a conveyor roller and a developer stirring unit. The developing roller is arranged to face a photoconductive drum, on a surface of which an electrostatic latent image is to be formed, at a predetermined developing position and supplies toner to the photoconductive drum. The developing roller includes a fixed first magnet having a plurality of magnetic poles along a circumferential direction and a first sleeve configured to rotate in a first rotational direction around the first magnet and carry developer containing the toner and magnetic carrier on a peripheral surface. The conveyor roller is arranged to face the developing roller at a predetermined facing position and supplies the developer to the developing roller. The conveyor roller includes a fixed second magnet having a plurality of magnetic poles along a circumferential direction and a second sleeve configured to rotate in a second rotational direction around the second magnet and carry the developer on a peripheral surface. The developer stirring unit stirs the developer and supplies the developer to the conveyor roller. The first and second rotational directions are set to be opposite to each other at the facing position. The first magnet includes, in a first area downstream of the developing position in the first rotational direction and upstream of the facing position in the first rotational direction, a first magnetic pole composed of a predetermined magnetic pole and a second magnetic pole arranged downstream of and adjacent to the first magnetic pole in the first rotational direction and having the same polarity as the first magnetic pole. The developer having passed through the developing position is transferred from the developing roller to the conveyor roller after passing through a repulsive magnetic field formed by the first and second magnetic poles.

Further, an image forming apparatus according to another aspect of the present disclosure includes the above developing device, the photoconductive drum configured to receive the supply of the toner from the developing device and carry a toner image on the peripheral surface and an image forming unit configured to transfer the toner image from the photoconductive drum to a sheet.

DETAILED DESCRIPTION

Hereinafter, an image forming apparatus 10 according to a first embodiment of the present disclosure is described in detail based on the drawings. In this embodiment, a tandem color printer is illustrated as an example of the image forming apparatus. The image forming apparatus may be, for example, a copier, a facsimile machine, a complex machine of these or the like.

Figure 1:
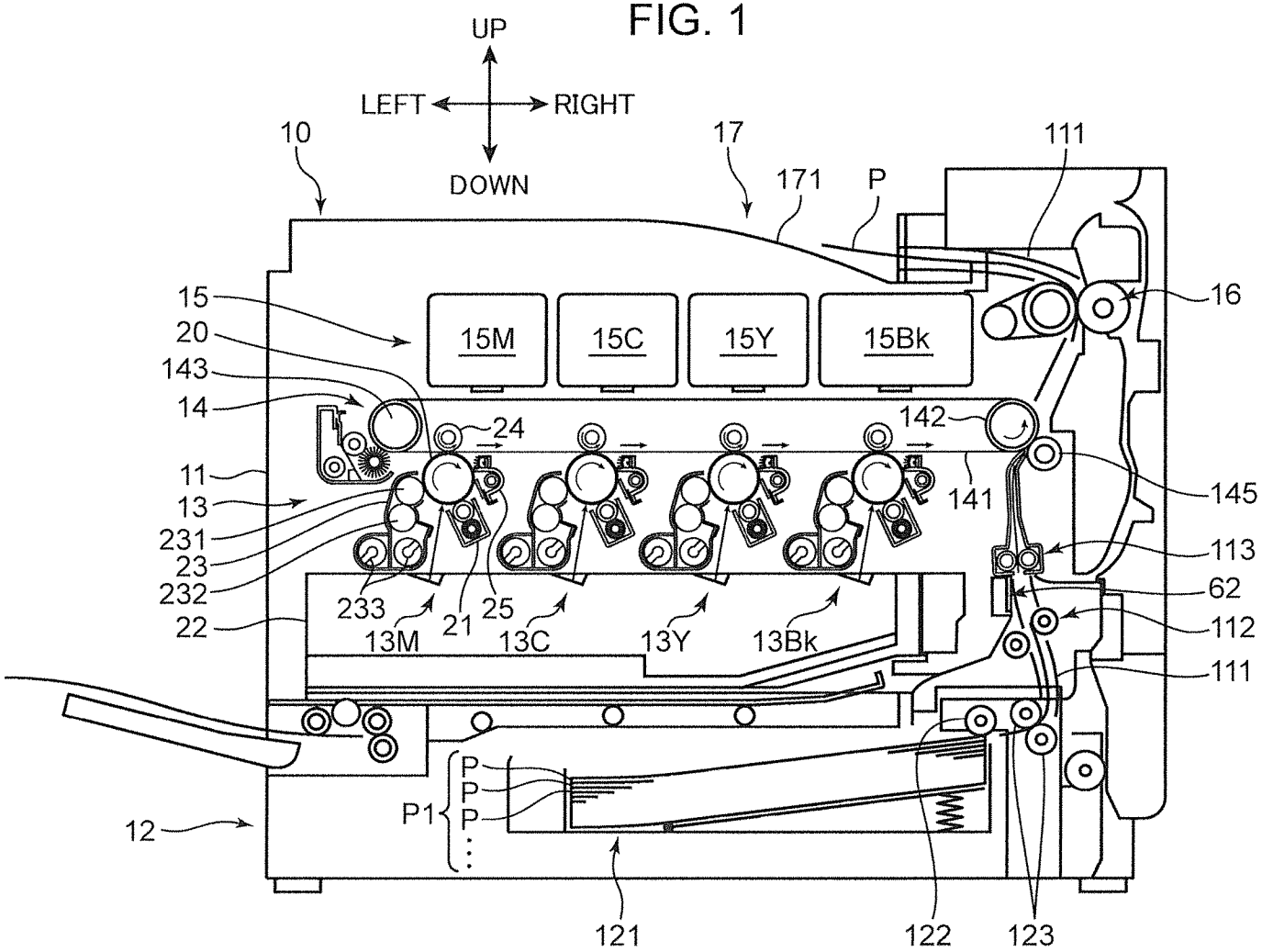
FIG. 1 is a sectional view showing an internal structure of an image forming apparatus according to a first embodiment of the present disclosure.

FIG. 1 is a sectional view showing an internal structure of the image forming apparatus 10. This image forming apparatus 10 includes an apparatus body 11 having a box-shaped housing structure. A sheet feeding unit 12 for feeding a sheet P, an image forming station 13 for forming a toner image to be transferred to the sheet P fed from the sheet feeding unit 12, an intermediate transfer unit 14 to which the toner image is to be primarily transferred, a second transfer roller 145, a toner supplying unit 15 for supplying toner to the image forming station 13 and a fixing unit 16 for fixing an unfixed toner image formed on the sheet P to the sheet P are housed in this apparatus body 11. Further, a sheet discharging unit 17 to which the sheet P having a fixing process applied thereto in the fixing unit 16 is to be discharged is provided on a top part of the apparatus body 11.

A sheet conveyance path 111 extending in a vertical direction is formed at a position to the right of the image forming station 13 in the apparatus body 11. A conveyor roller pair 112 for conveying a sheet is disposed at a suitable position of the sheet conveyance path 111. A registration roller pair 113 for correcting the skew of the sheet and feeding the sheet to a secondary transfer nip portion to be described later at a predetermined timing is also provided upstream of the nip portion in the sheet conveyance path 111. The sheet conveyance path 111 is a conveyance path for conveying the sheet P from the sheet feeding unit 12 to the sheet discharging unit 17 by way of the image forming station 13 (secondary transfer nip portion) and the fixing unit 16.

The sheet feeding unit 12 includes a sheet feed tray 121, a pickup roller 122 and a sheet feed roller pair 123. The sheet feed tray 121 is detachably mounted at a lower position of the apparatus body 11 and stores a sheet bundle P1 in which a plurality of sheets P are stacked. The pickup roller 122 picks up the uppermost sheet of the sheet bundle P1 stored in the sheet feed tray 121 one by one. The sheet feed roller pair 123 feeds the sheet P picked up by the pickup roller 122 to the sheet conveyance path 111.

The image forming station 13 is for forming a toner image to be transferred to a sheet P and includes a plurality of image forming units for forming toner images of different colors. As these image forming units, a magenta unit 13 using developer of magenta (M), a cyan unit 13C using developer of cyan (C), a yellow unit 13Y using developer of yellow (Y) and a black unit 13Bk using developer of black (Bk) successively arranged from an upstream side toward a downstream side (from a left side to a right side shown in FIG. 1) in a rotational direction of an intermediate transfer belt 141 to be described later are provided in this embodiment. Each of the units 13M, 13C, 13Y and 13Bk includes a photoconductive drum 20 and a charging device 21, a developing device 23 and a cleaning device 25 arranged around the photoconductive drum 20. Further, an exposure device 22 common to each unit 13M, 13C, 13Y and 13Bk is arranged below the image forming units.

The photoconductive drum 20 is rotationally driven about an axis thereof and an electrostatic latent image and a toner image are formed on a peripheral surface thereof. A photoconductive drum using an amorphous silicon (a-Si) based material can be used as this photoconductive drum 20. Each photoconductive drum 20 is arranged to correspond to the image forming unit of each color. The charging device 21 uniformly charges the surface of the photoconductive drum 20. The charging device 21 includes a charging roller and a charge cleaning brush for removing the toner adhering to the photoconductive drum 20. The exposure device 22 includes various optical devices such as a light source, a polygon mirror, a reflection mirror and a deflection mirror and forms an electrostatic latent image by irradiating light modulated based on image data to the uniformly charged peripheral surface of the photoconductive drum 20. Further, the cleaning device 25 cleans the peripheral surface of the photoconductive drum 20 after the transfer of the toner image.

The developing device 23 supplies the toner to the peripheral surface of the photoconductive drum 20 to develop the electrostatic latent image formed on the photoconductive drum 20. The developing device 23 is for two-component developer composed of toner and carrier. Note that the toner has a property of being positively charged in this embodiment.

The intermediate transfer unit 14 is arranged in a space provided between the image forming station 13 and the toner supplying unit 15. The intermediate transfer unit 14 includes the intermediate transfer belt 141, a drive roller 142, a driven roller 143 and a primary transfer roller 24.

The intermediate transfer belt 141 is an endless belt-like rotary body and mounted between the drive roller 142 and the driven roller 143 such that a peripheral surface thereof is held in contact with the peripheral surface of each photoconductive drum 20. The intermediate transfer belt 141 is driven to turn in one direction and carries a toner image transferred from the photoconductive drums 20 on a surface.

The drive roller 142 stretches the intermediate transfer belt 141 at a right end side of the intermediate transfer unit 14 and drives and rotates the intermediate transfer belt 141. The drive roller 142 is formed of a metal roller. The driven roller 143 stretches the intermediate transfer belt 141 at a left end side of the intermediate transfer unit 14. The driven roller 143 applies a tension to the intermediate transfer belt 141.

The primary transfer roller 24 forms the primary transfer nip portion by sandwiching the intermediate transfer belt 141 between the primary transfer roller 24 and the photoconductive drum 20 and primarily transfers the toner image on the photoconductive drum 20 onto the intermediate transfer belt 141. Each primary transfer roller 24 is arranged to face the photoconductive drum 20 of each color.

The secondary transfer roller 145 is arranged to face the drive roller 142 across the intermediate transfer belt 141. The secondary transfer roller 145 forms a secondary transfer nip portion by being pressed into contact with the peripheral surface of the intermediate transfer belt 141. The toner image primarily transferred onto the intermediate transfer belt 141 is secondarily transferred to the sheet P supplied from the sheet feeding unit 12 in the secondary transfer nip portion. The intermediate transfer unit 14 and the secondary transfer roller 145 of this embodiment constitute a transfer unit of the present disclosure. The transfer unit transfers the toner image to the sheet P from the photoconductive drums 20.

The toner supplying unit 15 is for storing toner used for image formation and includes a magenta toner container 15M, a cyan toner container 15C, a yellow toner container 15Y and a black toner container 15Bk in this embodiment. These toner containers 15M, 15C, 15Y and 15Bk supply the toner of the respective colors to the developing devices 23 of the image forming units 13M, 13C, 13Y, 13Bk corresponding to the respective colors of MCYBk through unillustrated toner conveying units.

The sheet P supplied to the fixing unit 16 is heated and pressed by passing through a fixing nip portion. In this way, the toner image transferred to the sheet P in the secondary transfer nip portion is fixed to the sheet P.

The sheet discharging unit 17 is formed by recessing a top part of the apparatus body 11 and a sheet discharge tray 171 for receiving the discharged sheet P is formed on a bottom part of this recess. The sheet P having a fixing process applied thereto is discharged to the sheet discharge tray 171 by way of the sheet conveyance path 111 extending from the top of the fixing unit 16.

Figure 2:
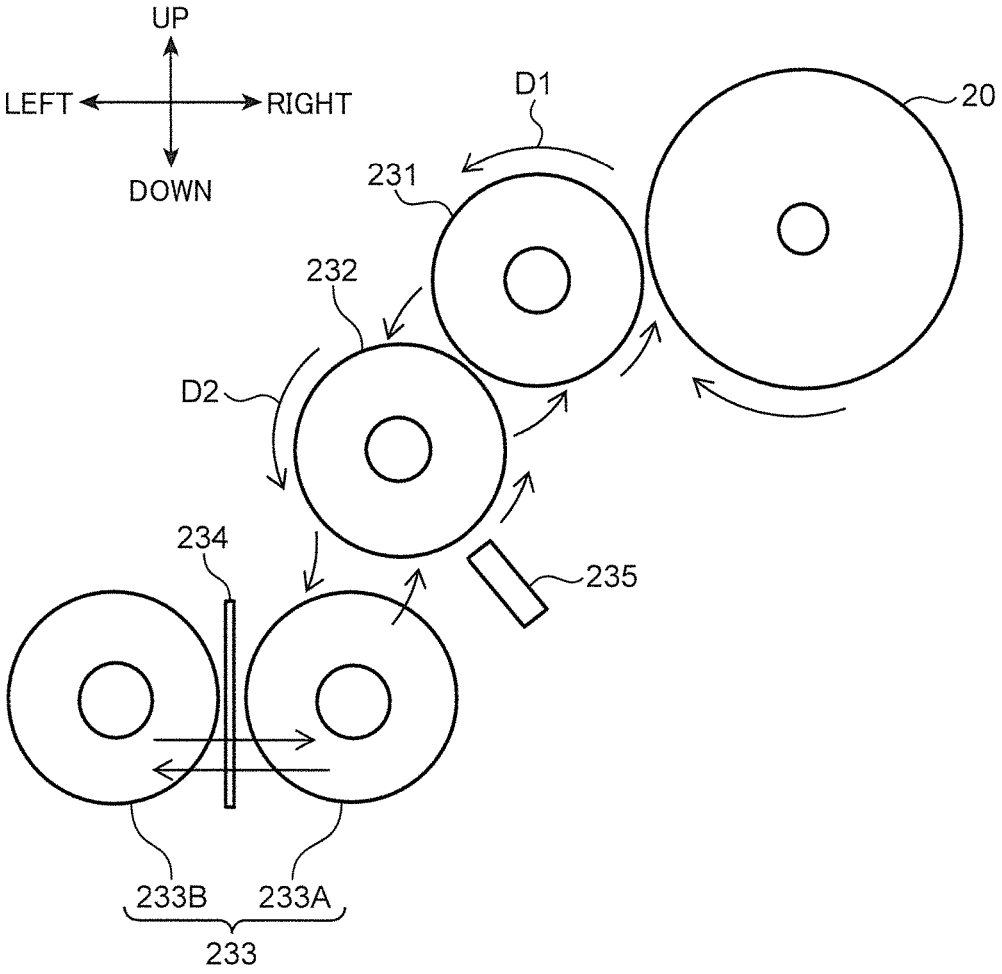
FIG. 2 is a schematic sectional view showing an internal structure of a developing device according to the first embodiment of the present disclosure.
Figure 3:
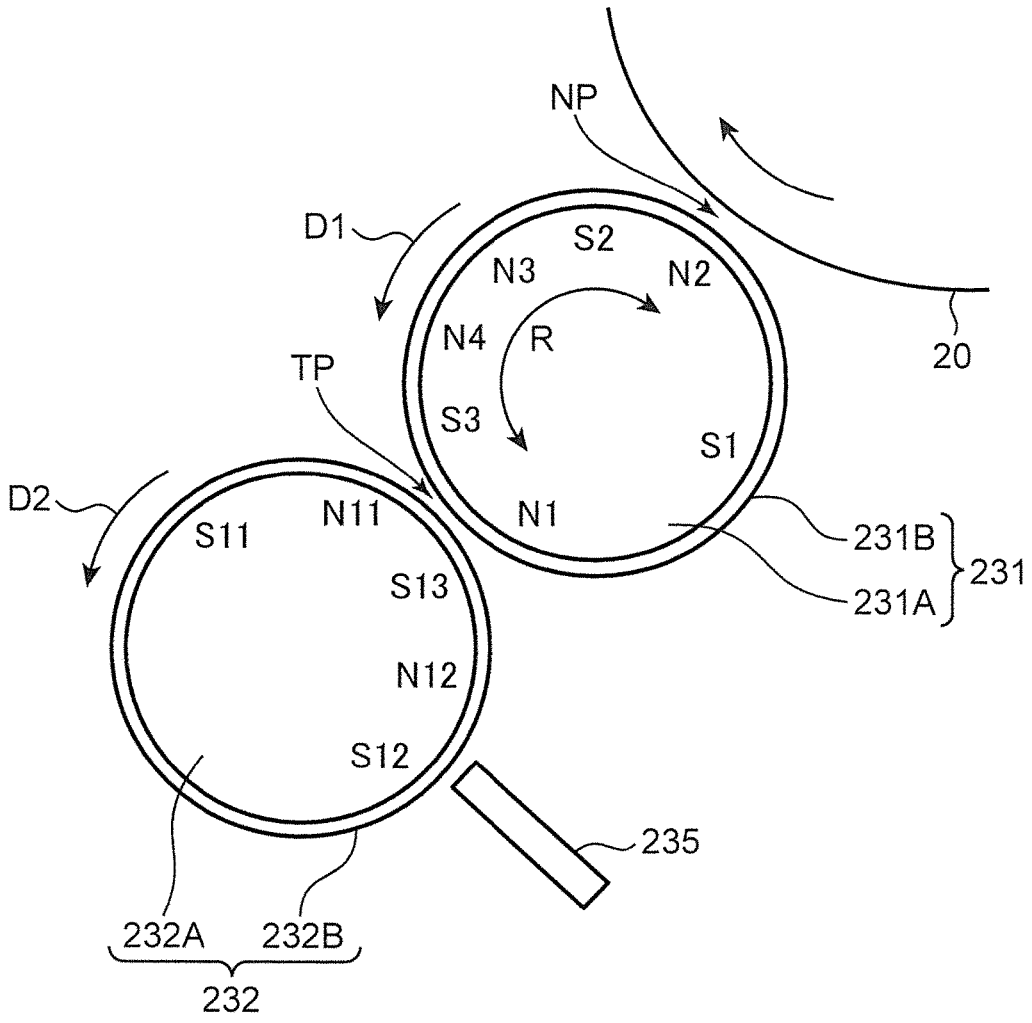
FIG. 3 is a schematic sectional view showing the arrangements of magnetic poles of a developing roller and a conveyor roller according to the first embodiment of the present disclosure.
Figure 4:
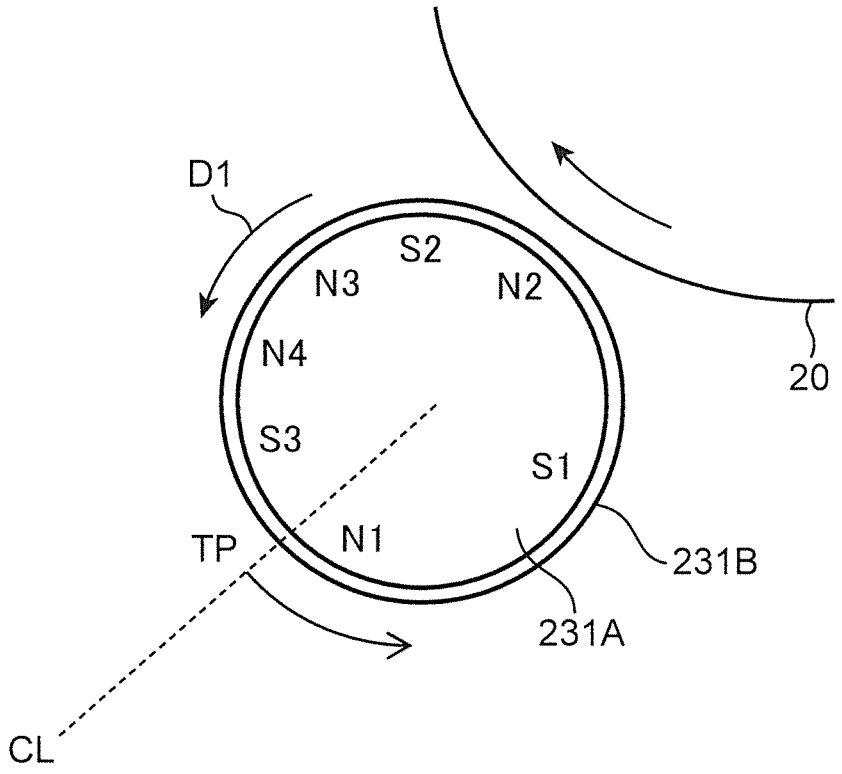
FIG. 4 is a schematic sectional view showing the arrangement of the magnetic poles of the developing roller according to the first embodiment of the present disclosure.
Figure 5:
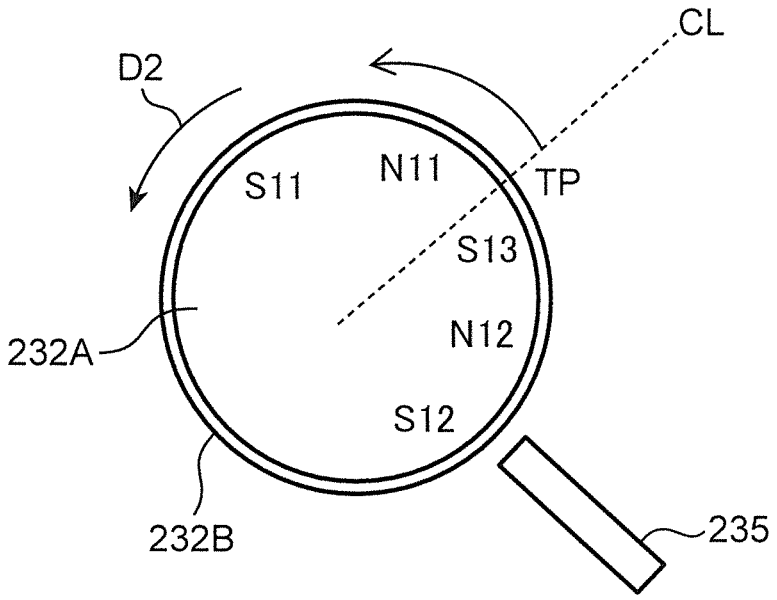
FIG. 5 is a schematic sectional view showing the arrangement of the magnetic poles of the conveyor roller according to the first embodiment of the present disclosure.
Figure 6:
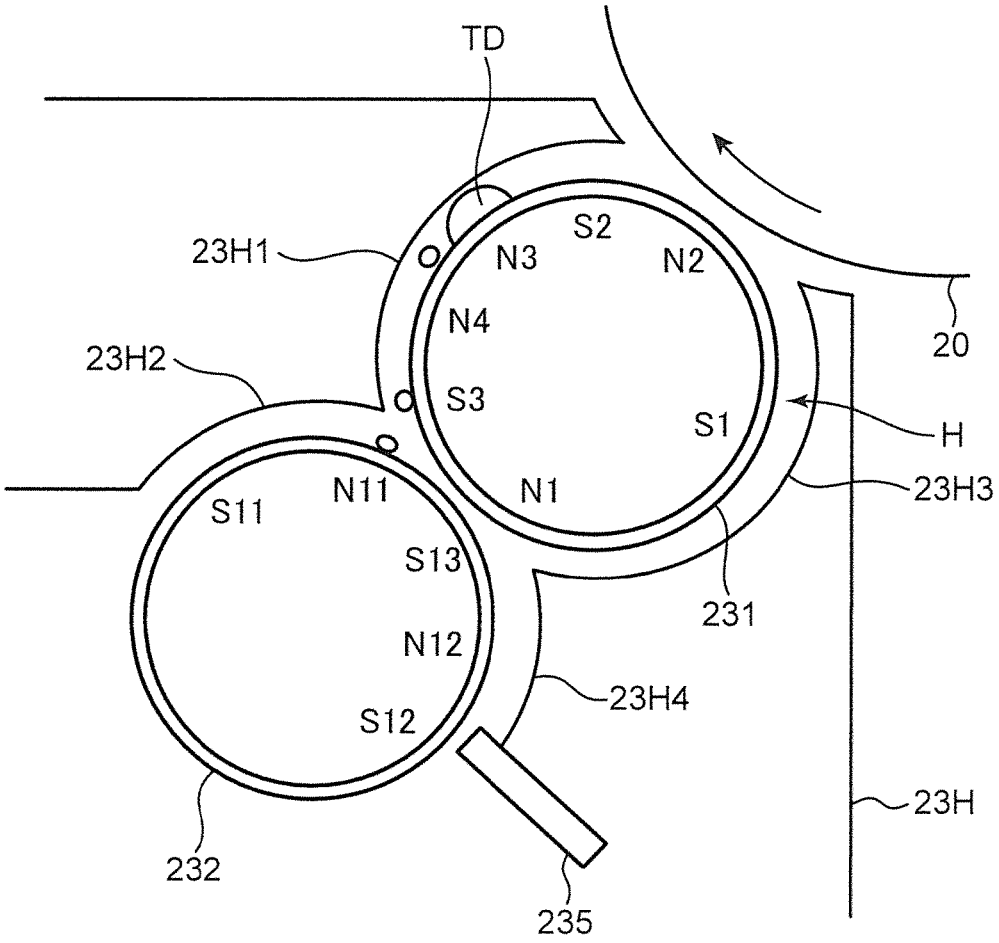
FIG. 6 is a schematic sectional view showing a state where a developer pool is generated in the developing device according to the first embodiment of the present disclosure.

Next, the developing device 23 according to this embodiment is further described in detail with reference to FIGS. 2 to 6 in addition to FIG. 1. FIG. 2 is a schematic sectional view showing an internal structure of the developing device 23 according to this embodiment. In FIG. 2, a rotational direction of each rotary member of the developing device 23 is shown by an arrow. FIG. 3 is a schematic sectional view showing the arrangements of magnetic poles of a developing roller 231 and a conveyor roller 232 according to the this embodiment. FIG. 4 is a schematic sectional view showing the arrangement of the magnetic poles of the developing roller 231. FIG. 5 is a schematic sectional view showing the arrangement of the magnetic poles of the conveyor roller 232. FIG. 6 is a schematic sectional view showing a state where a developer pool (retention portion TD) is generated in the developing device 23 according to this embodiment.

With reference to FIGS. 1 to 6, the developing device 23 includes a housing 23H, the developing roller 231, the conveyor roller 232, a stirring screw 233 (developer stirring unit) with two screws, a partition plate 234 and a layer thickness regulating member 235. The housing 23H is a casing body for supporting each member of the developing device 23.

The developing roller 231 is arranged to face the photoconductive drum 20, on a surface of which an electrostatic latent image is to be formed, at a predetermined developing position NP (FIG. 3) and supplies the toner to the photoconductive drum 20. The developing roller 231 includes a first magnet 231A and a first sleeve 231B (FIG. 3). Note that, in this embodiment, the developing position NP includes a position where the photoconductive drum 20 and the developing roller 231 are closest to each other. The first magnet 231A is a cylindrical magnet including a plurality of magnetic poles along a circumferential direction and fixed to the housing 23H. The first sleeve 231B rotates in a first rotational direction (direction of an arrow D1 in FIGS. 2 and 3) around the first magnet 231A and carries developer containing the toner and magnetic carrier on a peripheral surface. In this embodiment, the first sleeve 231B is formed of a circular pipe member (base member) made of aluminum. Sandblasting (blasting) is applied to the peripheral surface of the circular pipe member of the first sleeve 231B and the circular pipe member includes a Ni plating layer applied on the peripheral surface thereof. A surface of the Ni plating layer of the first sleeve 231B has a predetermined surface roughness. In this embodiment, the surface roughness Rzjis of the first sleeve 231B is set in a range of 4.0 μm to 14.0 μm. The first sleeve 231B of the developing roller 231 is rotatably supported on the housing 23H.

The conveyor roller 232 is arranged to face the developing roller 231 at a predetermined facing position TP (FIG. 3) and supplies the developer to the developing roller 231. Note that, in this embodiment, the facing position TP includes a position where the conveyor roller 232 and the developing roller 231 are closest to each other. The conveyor roller 232 includes a second magnet 232A and a second sleeve 232B. The second magnet 232A includes a plurality of magnetic poles along a circumferential direction and is fixed to the housing 23H. The second sleeve 232B rotates in a second rotational direction (direction of an arrow D2 in FIGS. 2 and 3) around the second magnet 232A and carries the developer containing the toner and the carrier on a peripheral surface. The second sleeve 232B of the conveyor roller 232 is rotatably supported on the housing 23H.

Note that development biases in which an AC bias is superimposed on a DC bias are applied to the developing roller 231 and the conveyor roller 232. Further, as shown in FIG. 3, the first rotational direction D1 of the developing roller 231 and the second rotational direction D2 of the conveyor roller 232 are set to be opposite to each other at the facing position TP (counter directions).

The stirring screw 233 charges the toner by conveying two-component developer in a circulating manner while stirring this developer. The stirring screw 233 includes a first screw 233A and a second screw 233B. Note that although not shown in FIG. 2, the housing 23H includes an unillustrated first stirring portion in which the first screw 233A is arranged and an unillustrated second stirring portion in which the second screw 233B is arranged (see the developing device 23 of FIG. 1). The developer is conveyed in a circulating manner between the first and second screws 233A, 233B. The first screw 233A supplies the developer to the conveyor roller 232. The partition plate 234 is a plate-like member provided in the housing 23H. The partition plate 234 partitions between the first and second stirring portions along axial directions of the first and second screws 233A, 233B. Further, the toner supplied from the toner supplying unit 15 flows into the housing 23H from one axial end side of the second screw 233B and is stirred with the other developer.

The layer thickness regulating member 235 is a plate-like member made of nonmagnetic metal and arranged to face the peripheral surface of the conveyor roller 232. Note that a magnetic member may be fixed to an upstream side surface of the layer thickness regulating member 235 in another embodiment. The layer thickness regulating member 235 regulates a layer thickness of the developer supplied to the conveyor roller 232 from the first screw 233A of the stirring screw 233.

Further, as shown in FIG. 2, an axial center of the developing roller 231 is arranged below that of the photoconductive drum 20 and an axial center of the conveyor roller 232 is arranged further below that of the developing roller 231.

Further, with reference to FIG. 2, the developer composed of the toner and the carrier and conveyed in a circulating manner by the stirring screw 233 is supplied from the first screw 233A to the conveyor roller 232. Thereafter, this developer is supplied to the developing roller 231 after the layer thickness of the developer is regulated by the layer thickness regulating member 235. When part of the toner is supplied to the photoconductive drum 20 at the developing position NP (FIG. 3), the developer is collected from the developing roller 231 to the conveyor roller 232. Thereafter, the developer collected to the conveyor roller 232 flows again into the first stirring portion around the first screw 233A.

With reference to FIGS. 3 and 4, the first magnet 231A of the developing roller 231 has seven magnetic poles along the circumferential direction. An N1 pole is arranged downstream of the facing position TP between the developing roller 231 and the conveyor roller 232 in the first rotational direction (D1). Further, an S1 pole is arranged downstream of the N1 pole in the first rotational direction. The S1 pole functions as a carrying pole for carrying the developer received from the conveyor roller 232 toward the photoconductive drum 20. Further, an N2 pole functioning as a main pole for supplying the toner to the photoconductive drum 20 is arranged downstream of the S1 pole in the first rotational direction. The N2 pole is arranged near the developing position NP.

Further, the first magnet 231A has four magnetic poles (S2, N3, N4, S3) in a first region R downstream of the developing position NP in the first rotational direction and upstream of the facing position TP in the first rotational direction. The N3 pole (first magnetic pole) is arranged substantially in a central part of the first region R. The N4 pole (second magnetic pole) is a magnetic pole arranged downstream of and adjacent to the N3 pole in the first rotational direction and having the same polarity as the N3 pole. The S2 pole (third magnetic pole) is a magnetic pole arranged upstream of and adjacent to the N3 pole in the first rotational direction and having a polarity different from the N3 pole. The S3 pole (fourth magnetic pole) is a magnetic pole arranged downstream of and adjacent to the N4 pole in the first rotational direction and having a polarity different from the N4 pole.

Table 1 shows magnets 1 and 2 with angles of seven magnetic poles illustrated as the first magnet 231A according to this embodiment. Note that magnetic forces (peak values of radial components) of some poles of the magnets 1 and 2 differ from each other in magnitude. Magnetic flux density of the pole is hereinafter referred to as magnetic force of the pole. Further, the angle of each magnetic pole shown in Table 1 is shown along the first rotational direction with the facing position TP of FIG. 4 as a starting point (angle 0°). Note that a straight line CL connecting the facing position TP and a rotation axis center of the developing roller 231 is shown in FIG. 4.

TABLE 1

| MAGNETIC POLE | ANGLE | MAGNET 1 | MAGNET 2 |
|---|---|---|---|
| N1 | 30° | 75 mT | 75 mT |
| S1 | 105° | 70 mT | 70 mT |
| N2 | 170° | 100 mT | 100 mT |
| S2 | 220° | 70 mT | 70 mT |
| N3 | 270° | 70 mT | 45 mT |
| N4 | 290° | 70 mT | 45 mT |
| S3 | 340° | 55 mT | 55 mT |

On the other hand, with reference to FIGS. 3 and 5, the second magnet 232A of the conveyor roller 232 has five magnetic poles along the circumferential direction. An N11 pole is arranged downstream of the facing position TP between the developing roller 231 and the conveyor roller 232 in the second rotational direction (D2). Further, an S11 pole is arranged downstream of the N11 pole in the second rotational direction. Further, an S12 pole is arranged downstream of the S11 pole in the second rotational direction. The S11 pole functions as a peeling pole for peeling the developer received from the conveyor roller 232. The S12 pole functions as a draw-up pole for drawing up the developer from the first screw 233A. An N12 pole and an S13 pole are arranged downstream of the S12 pole in the second rotational direction. As shown in FIG. 5, the aforementioned layer thickness regulating member 235 is arranged to face at a predetermined distance from the second magnet 232A of the conveyor roller 232 between the S12 and N12 poles on a side upstream of the S13 pole in the second rotational direction. Thus, the layer thickness of the developer can be stably regulated before the developer is transferred from the conveyor roller 232 to the developing roller 231. Note that the S13 pole is arranged adjacent to the N11 pole across the facing position TP.

Table 2 shows angles and magnetic forces (peak values of radial components) of five magnetic poles as an example of the second magnet 232A according to this embodiment. The angle of each magnetic pole shown in Table 2 is shown along the second rotational direction with the facing position TP of FIG. 5 as a starting point (angle 0°). Note that a straight line CL connecting the facing position TP and a rotation axis center of the conveyor roller 232 is shown in FIG. 5.

TABLE 2

| MAGNETIC POLE | ANGLE | MAGNETIC FORCE |
|---|---|---|
| N11 | 30° | 70 mT |
| S11 | 91° | 45 mT |
| S12 | 223° | 70 mT |
| N12 | 277° | 45 mT |
| S13 | 330° | 55 mT |

With reference to FIGS. 2 and 3, the arrangements and functions of the magnetic poles of the first magnet 231A of the developing roller 231 and the second magnet 232A of the conveyor roller 232 are further described. The N11 pole (fifth magnetic pole) of the second magnet 232A is a magnetic pole arranged to face the S3 pole of the first magnet 231A and having a polarity different from the S3 pole. The developer having passed through the developing position NP is transferred from the developing roller 231 to the conveyor roller 232 by a magnetic field formed by the N11 pole and the S3 pole.

Further, the N1 pole (sixth magnetic pole) of the first magnet 231A is a magnetic pole arranged downstream of and adjacent to the S3 pole in the first rotational direction across the facing position TP and having a polarity different from the S3 pole. Furthermore, the S13 pole (seventh magnetic pole) of the second magnet 232A is a magnetic pole upstream of and adjacent to the N11 pole in the second rotational direction across the facing position TP, arranged to face the N1 pole and having a polarity different from the N11 pole. The developer supplied from the first screw 233A of the stirring screw 233 to the conveyor roller 232 is transferred from the conveyor roller 232 to the developing roller 231 by a magnetic field formed by the N1 pole and the S13 pole after being regulated by the layer thickness regulating member 235.

With reference to FIG. 6, the housing 23H includes a plurality of inner wall portions facing the developing roller 231 and the conveyor roller 232. Specifically, the housing 23H includes a first inner wall portion 23H1, a second inner wall portion 23H2, a third inner wall portion 23H3 and a fourth inner wall portion 23H4. The first inner wall portion 23H1 extends along the peripheral surface of the first sleeve 231B of the developing roller 231 to face the S2, N3, N4 and S3 poles. The second inner wall portion 23H2 is connected to the first inner wall portion 23H1 and extends along the peripheral surface of the second sleeve 232B of the conveyor roller 232 to face the N11 and S11 poles. Similarly, the third inner wall portion 23H3 extends along the peripheral surface of the first sleeve 231B of the developing roller 231 to face the S1 and N1 poles. The first sleeve 231B of the developing roller 231 is arranged to be partially exposed and face the photoconductive drum 20 between the first and third inner wall portions 23H1, 23H3. The fourth inner wall portion 23H4 is connected to the third inner wall portion 23H3 and extends along the peripheral surface of the second sleeve 232B of the conveyor roller 232 to face the S13 and N12 poles. Note that, as shown in FIG. 6, substantially equal clearances H (conveyance path for the developer) are formed between the respective inner wall portions and the first sleeve 231B of the developing roller 231 and the second sleeve 232B of the conveyor roller 232. In this embodiment, heights of these clearances H are smaller than radii of the developing roller 231 and the developing roller 232 and set in a range of 0.5 mm to 2.0 mm.

As described above, development biases in which an AC bias is superimposed on a DC bias are applied to the developing roller 231 and the conveyor roller 232 during a developing operation of developing an electrostatic latent image on the photoconductive drum 20. Since this causes an oscillating electric field by the AC bias to be formed at the developing position NP (development nip), fogging toner adhering to a background part on the photoconductive drum 20 can be collected. However, such an oscillating electric field attracts the toner also onto the first sleeve 231B of the developing roller 231. As a result, a toner layer (toner film) is easily formed on the surface of the first sleeve 231B.

Figure 9:
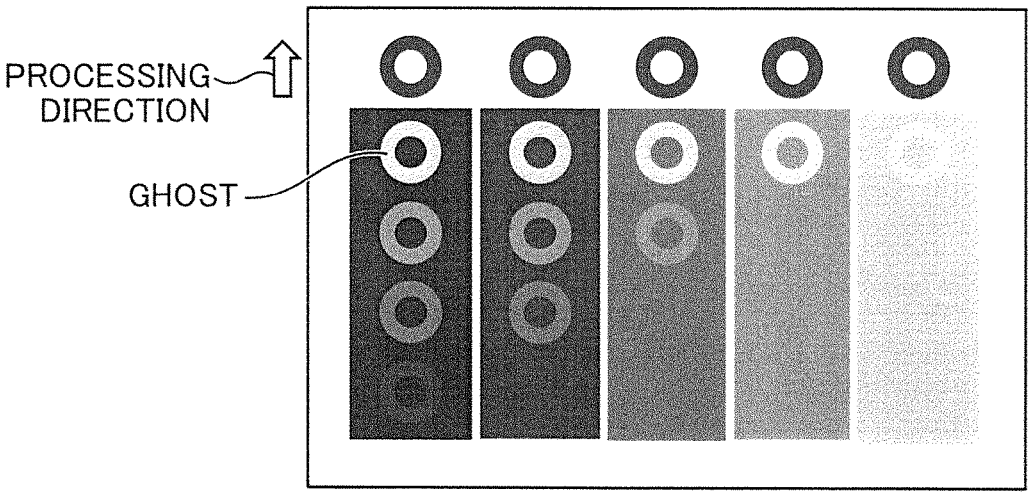
FIG. 9 is a diagram showing a state where ghosts are generated on a print.

A thickness of the toner layer formed on the first sleeve 231B of the developing roller 231 differs between an image part and a background part and this thickness difference remains as a history. FIG. 9 is a diagram showing ghost images generated on halftone images by such a toner consumption history. A history of ring-shaped images formed on an upstream side in a processing direction (sheet conveying direction) appears on succeeding halftone images. Such a history is based on a toner consumption amount difference in the above toner layer and due to a partial shift of a potential difference between the first sleeve 231B and the photoconductive drum 20 by electric charges of the remaining toner in the next halftone image.

In this embodiment, the forming of toner layer on the developing roller 231, which is one roller facing the photoconductive drum 20, in the developing device 23 in which two magnetic rollers (developing roller 231, conveyor roller 232) and the generation of ghost images as described above are suitably suppressed. Specifically, the developing roller 231 of the developing device 23 has the aforementioned N3 and N4 poles to suppress such ghost images. Thus, even if a history of the toner consumed at the developing position NP remains in the toner layer on the first sleeve 231B, the history of the toner is eliminated (polished) by a magnetic brush of the developer when the developer passes through a repulsive magnetic field formed by adjacent magnetic poles having the same polarity.

Figure 7:
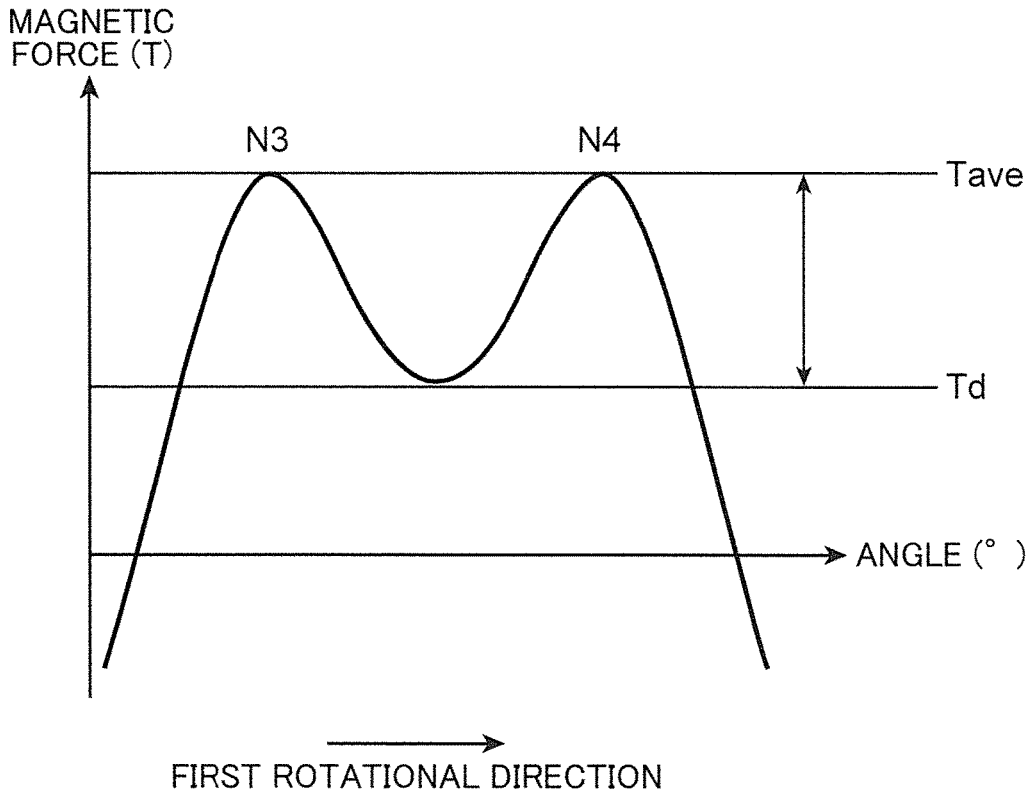
FIG. 7 is a graph showing a magnetic force distribution of a radial component between adjacent poles having the same polarity in the developing roller of the developing device according to the first embodiment of the present disclosure.

FIG. 7 is a graph showing a magnetic force distribution of a radial component between the N3 and N4 poles, which are adjacent magnetic poles having the same polarity, in the developing roller 231 of the developing device 23 according to this embodiment. Note that a peak magnetic force of the N3 pole and that of the N4 pole are shown substantially as an equal value in FIG. 7. In this embodiment, a relationship of:

$$Tave - Td \geq 15 \quad \text{(Equation 1)}$$

is satisfied when Tave (mT) denotes an average value of the peak magnetic force of the N3 pole and that of the N4 pole and Td (mT) denotes a minimum value of the magnetic force (trough part of the magnetic force) arranged between a peak position of the N3 pole and that of the N4 pole in a circumferential distribution of a radial component of the magnetic force of the first magnet 231A.

By setting a large difference between the average value Tave of the peak magnetic forces of the N3 and N4 poles and the magnetic force Td of the trough part between the both in this way, a repulsive magnetic force formed by the N3 and N4 poles increases. In this case, the developer conveyed from the N2 pole to the S2 pole and further to the N3 pole of the developing roller 231 is less likely to move to the N4 pole and, hence, partially retained on the N3 pole as shown in FIG. 6. As a result, the retention portion TD of the developer is formed on the first sleeve 231B of the developing roller 231. In the retention portion TD, the magnetic brush of the developer is retained while slipping on the first sleeve 231B. Thus, even if the history of the toner consumed at the developing position NP remains in the toner layer on the first sleeve 231B, the history of the toner is eliminated (polished) by the magnetic brush of the developer retained in the retention portion TD. Thus, the developing device 23 having the generation of ghosts as described above suppressed is provided. Particularly, when a peak position of a magnetic force is not present at the facing position TP between the developing roller 231 and the conveyor roller 232 as in this embodiment, a polishing force (scraping force) of the magnetic brush of the developer on the conveyor roller 232 is less likely to reach the surface of the first sleeve 231B. Even in such a case, the retention portion TD can be suitably formed by the repulsive force of the N3 and N4 poles provided in the developing roller 231. Note that such a retention portion TD cannot be sufficiently formed by a known developer peeling pole. By satisfying Equation 1 as described above, the retention portion TD can be formed which can polish the toner layer on the first sleeve 231B. In this embodiment, one developing roller 231 is arranged to face the photoconductive drum 20 and develops an electrostatic latent image on the photoconductive drum 20. Thus, the electrostatic latent image needs to be stably developed at one developing position NP as compared to another developing device in which a plurality of developing rollers are adjacently arranged along the peripheral surface of the photoconductive drum 20. In other words, in the case of arranging the plurality of developing rollers along the rotational direction of the photoconductive drum 20 as described above, a density reduced part of a ghost image formed by the developing roller on an upstream side can be corrected by the developing roller on a downstream side. On the other hand, in this embodiment, if the history of the toner consumption formed on the first sleeve 231B of the developing roller 231 becomes a ghost image during the next rotation, it is difficult to correct. Thus, the next rotation of the history of the toner layer toward the developing position NP can be suitably suppressed by satisfying the above Equation 1. As a result, the complication of the structure of the developing device 23 is suppressed and a cost increase of the developing device 23 is suppressed.

In this embodiment, the N3 and N4 poles are formed of one fan-shaped ferrite magnet and two magnetic poles having the same polarity are formed by partially forming a cut in a circumferentially central part of the fan shape. A magnetic force difference between the peak value of the N3 pole and that of the N4 pole is set in a range of 25 mT or less. Within this range, how the retention portion TD is formed can be judged based on the average value Tave of the peak values of the both poles. Also when two magnetic poles having the same polarity are formed by two adjacent magnet pieces, how the retention portion TD is formed can be similarly judged based on the average value Tave of the peak values of the both poles if the magnetic force difference between the peak value of the N3 pole and that of the N4 pole is set in the range of 25 mT or less.

Further, the first sleeve 231B is formed of the circular pipe member (base member) made of aluminum. Further, sand-blasting (blasting) is applied to the peripheral surface of the circular pipe member of the first sleeve 231B and the circular pipe member includes the Ni plating layer applied on the peripheral surface thereof. Thus, the developer easily slips due to a surface property of the first sleeve 231B having blasting applied thereto and the retention portion TD of the developer is stably formed. Further, a charge amount of positively charged toner is easily reduced by the plating layer on the developing roller 231. As a result, a charge amount of the developer is reduced, the slip of the developer in the retention portion TD is promoted and an adhering force of the toner to the sleeve surface becomes smaller. Thus, the generation of ghost images is further suppressed. Note that the first sleeve 231B of the developing roller 231 may have a known groove shape instead of having blasting applied in another embodiment as described later. In this case, by performing outer periphery polishing such as centerless machining before or after groove formation or performing blasting after groove formation, the adhering force of the toner to the sleeve surface is reduced and the generation of ghost images is more suppressed as compared to the case where the first sleeve 231B has only a mere groove shape.

With reference to FIG. 6, the overflowing developer without being held by the magnetic force of the N3 pole (excess developer) jumps over the N4 pole and moves to the S3 pole as the amount of the developer of the retention portion TD on the developing roller 231 gradually increases. Thereafter, the developer is transferred from the developing roller 231 to the conveyor roller 232 by a magnetic field formed by the S3 and N11 poles. The toner in the developer may scatter when the developer jumps from the N3 pole toward the S3 pole. Thus, focusing on the first region (FIG. 3) of the developing roller 231, a relationship of Equation 2 is desirably satisfied when X (°) denotes an inter-pole angle between a peak position of the N3 pole and that of the S2 pole, Y (°) denotes an inter-pole angle between a peak position of the N4 pole and that of the S3 pole, E (mT) denotes the sum of a peak magnetic force of the N3 pole and that of the S2 pole and F (mT) denotes the sum of a peak magnetic force of the N4 pole and that of the S3 pole in a circumferential distribution of a radial component of the magnetic force of the first magnet 231A.

$$E/X>F/Y \quad \text{(Equation 2)}$$

In Equation 2, a developer holding force formed by the N3 and S2 poles and that formed by the N4 and S3 poles are specified by an inequality. The above Equation 2 is easily satisfied when the inter-pole angle is smaller and when the sum of the peak magnetic forces is larger on an upstream side in the first rotational direction across the N3 and N4 poles having the same polarity. When the developer holding force on the upstream side in the first rotational direction is large as just described, the retention portion TD of the developer in FIG. 6 is stably formed and more raised. As a result, a top part of the retention portion TD easily contacts the first inner wall portion 23H1 of the housing 23H. In this case, the developer conveyance path is partially closed with the developer of the retention portion TD. Thus, even if the toner scatters in the vicinity of the N4 pole, it is suppressed that this toner reaches the side of the developing position NP. Therefore, the occurrence of toner fogging and toner stain on an image is suppressed. Further, when the relationship of Equation 2 is satisfied, a pressure is applied to the developer of the retention portion TD between the first inner wall portion 23H1 and the first sleeve 231B. Thus, a polishing force for the surface of the first sleeve 231B by the developer of the retention portion TD is increased.

Further, in this embodiment, the S3 pole having a polarity different from the N4 pole is arranged downstream of the N4 pole in the first rotational direction as shown in FIG. 6. Thus, the developer separated from the N3 pole can be stably captured by the S3 pole. Further, by arranging the N11 pole having a polarity different from the S3 pole, the developer can be stably transferred from the developing roller 231 to the conveyor roller 232. At this time, since the first and second inner wall portions 23H1, 23H2 are connected to each other while being formed along the peripheral surfaces of the developing roller 231 and the conveyor roller 232, the developer can be smoothly transferred from the developing roller 231 to the conveyor roller 232. Further, with reference to FIG. 6, the axial center of the developing roller 231 is arranged below that of the photoconductive drum 20 and the axial center of the conveyor roller 232 is arranged below that of the developing roller 231. Thus, coupled with a gravitational action, the overflowing developer is stably transferred to the side of the conveyor roller 232 after moving to the S3 pole beyond the N4 pole.

Further, in this embodiment, the N1 pole is arranged downstream of the S3 pole in the first rotational direction and the S13 pole is arranged upstream of the N11 pole in the second rotational direction. The developer can be stably supplied from the conveyor roller 232 to the developing roller 231 by a magnetic field formed by the N1 and S13 poles. Thus, developer transfer regions between the developing roller 231 and the conveyor roller 232 are stably formed in different directions in places at opposite sides of the facing position TP. Further, the developer of the retention portion TD having jumped from the S3 pole beyond the N4 pole is less likely to move to the S13 pole. This is because the S13 pole is a magnetic pole having the same polarity as the S3 pole. Note that, in this embodiment, a gap between the developing roller 231 and the photoconductive drum 20 (developing position NP) is set to be larger than 0.25 mm and not larger than 0.40 mm as an example. On the other hand, a gap between the developing roller 231 and the conveyor roller 232 (facing position TP) is set to be not smaller than 0.18 mm and not larger than 0.25 mm. In other words, the gap between the developing roller 231 and the conveyor roller 232 is set to be narrower than the gap between the developing roller 231 and the photoconductive drum 20. The developer is transferred between the developing roller 231 and the conveyor roller 232 across the facing position TP set to be narrow in this way. Note that the peak position of none of the magnetic poles is facing the facing position TP as described above. Thus, even if the gap of the facing position TP is set to be narrow as described above, it is suppressed that the developer present at the facing position TP is fixed. Further, since two magnetic brushes of the developer for transfer are formed across the facing position TP in the circumferential direction, even if the toner scatters at the facing position TP, this toner can be confined.

Next, the first embodiment of the present disclosure is further described on the basis of examples. Note that the present disclosure is not limited to the following examples.

Experiment 1

Experiment 1 was conducted under the following experimental conditions.

Experimental Conditions

Photoconductive drum 20: amorphous silicon photoconductor (a-Si) having a diameter ϕ of 30 mm, a surface potential Vo=270 V and a circumferential speed=300 mm/sec Gap between layer thickness regulating member 235 and second sleeve 232B: 200 to 600 μm Developer conveyance amount (after layer thickness regulation) on developing roller 231: 250 g/m$^2$ Carrier: a volume average particle diameter of 35 μm, a magnetic force of 80 emu/g Toner: a volume average particle diameter of 6.8 μm, a toner density of 7% Conditions of the developing roller 231 used in Experiment 1 are as follows.

Developing roller 231: a diameter ϕ of 20 mm

Circumferential speed ratio of the developing roller 231 to photoconductive drum 20: 1.6

Gap between developing roller 231 and photoconductive drum 20: 300 μm

Development bias: DC bias=170 V, AC bias=Vpp 1.4 kV, a frequency f of 4.7 kHz, a duty ratio of 50%, rectangular wave (note that the development bias of the conveyor roller 232 also has the same potential)

Surface conditions of first sleeve 231B:

(Condition 1) Knurled V grooves (groove depth of 80 μm, groove width of 0.2 mm, the number of grooves of 120), Ni plating (Condition 2) Sandblasting (Rzjis before plating=8 μm), Ni plating (Condition 3) Sandblasting (Rzjis=8 μm), no plating Further, a magnetic pole distribution of the developing roller 231 used in Experiment 1 is as in the magnets 1 and 2 shown in the previous Table 1. Note that the following magnetic force measurement of the developing roller 231 and the conveyor roller 232 was conducted using a GAUSS METER Model GX-100 produced by Nihon Denji Sokki Co., Ltd.

Further, conditions of the conveyor roller 232 used in Experiment 1 are as follows.

Conveyor roller 232: a diameter ϕ of 20 mm

Surface conditions of second sleeve 232B: knurled V grooves (groove depth of 80 μm, groove width of 0.2 mm, the number of grooves of 120)

Circumferential speed ratio of conveyor roller 232 to developing roller 231: 1.0

Gap between conveyor roller 232 and developing roller 231: 250 μm

Further, a magnetic pole distribution of the conveyor roller 232 used in Experiment 1 is as shown in the previous Table 2.

Experiment 1 was conducted with a relationship of a magnetic force waveform between the N3 and N4 poles in two first magnets 231A, i.e. the magnets 1 and 2 changed under the above conditions. Table 3 shows a list of examples and comparative examples of Experiment 1 and evaluation results of development ghosts (ghost images) under the respective conditions.

TABLE 3

| EXPERIMENT | SLEEVE SURFACE PROCESSING | MAGNETIC FORCE DIFFERENCE (Tave − Td) | GHOST EVALUATION MAGNET 1 | GHOST EVALUATION MAGNET 2 |
|---|---|---|---|---|
| COMPARATIVE EXAMPLE 1-1 | KNURLING + PLATING | 10 mT | 2 | 2 |
| EXAMPLE 1-1 | KNURLING + PLATING | 15 mT | 3.5 | 3.5 |
| EXAMPLE 1-2 | KNURLING + PLATING | 20 mT | 4 | 4 |
| EXAMPLE 1-3 | KNURLING + PLATING | 25 mT | 4 | 4 |
| COMPARATIVE EXAMPLE 1-2 | BLASTING(Rz8 μm) + PLATING | 10 mT | 2 | 2 |
| EXAMPLE 1-4 | BLASTING(Rz8 μm) + PLATING | 15 mT | 4 | 4 |
| EXAMPLE 1-5 | BLASTING(Rz8 μm) + PLATING | 20 mT | 5 | 5 |
| EXAMPLE 1-6 | BLASTING(Rz8 μm) + PLATING | 25 mT | 5 | 5 |
| EXAMPLE 1-7 | BLASTING(Rz8 μm) | 15 mT | 3.5 | 3.5 |
| EXAMPLE 1-8 | KNURLING | 15 mT | 3 | 3 |

Note that a development ghost generation level is visually ranked based on the following criteria after a pattern image as shown in FIG. 9 is printed and a level of 3 or higher is determined to be an OK level.

5: Not at all (no problem in actual use)

4: Confirmable upon close examination, but not annoying (no problem in actual use)

3: Generated, but not alloying (no problem in actual use)

2: Confirmable

1: Clearly confirmable

In Comparative Example 1-1, a magnetic force difference between the N3 and N4 poles was small and the retention portion TD (FIG. 6) of the developer was not sufficiently formed. Thus, development ghosts were generated. Further, in Examples 1-1, 1-2 and 1-3, the magnetic force difference between the N3 and N4 poles was sufficient and the conveyance of the developer from the N3 pole to the N4 pole was temporarily obstructed. Thus, the retention portion TD of the developer was sufficiently formed. As a result, the generation of development ghosts was suppressed. On the other hand, in Comparative Example 1-2, conveyance performance of the first sleeve 231B of the developing roller 231 was reduced and the retention portion TD was more easily formed as compared to Comparative Example 1-1, but the magnetic force difference between the N3 and N4 poles was small. Thus, the retention portion TD was not sufficiently formed and development ghosts were generated. In Examples 1-4, 1-5 and 1-6, since the conveyance performance of the first sleeve 231B was reduced as compared to Examples 1-1, 1-2 and 1-3, the retention portion TD of the developer was notably formed and development ghosts were further improved. In Example 1-7, a development ghost suppressing effect was somewhat reduced since no plating was applied to a blasted surface of the first sleeve 231B, but a level was not problematic in actual use. Further, Example 1-8 has only the condition of the knurled grooves making the developer difficult to slip on the first sleeve 231B, but the magnetic force difference between the N3 and N4 poles was ensured to be a minimum of 15 mT. Thus, a level was similarly not problematic in actual use. As just described, an effect of suppressing development ghosts was obtained by satisfying the aforementioned relationship of Equation 1.

Note that Conditions 2, 3 of the first sleeve 231B were found to give results similar to the above as a result of conducting a similar evaluation in a range of Rzjis of not smaller than 4 μm and not larger than 14 μm. Further, it was confirmed that there was no difference in Rzjis of the first sleeve 231B before and after plating if a film thickness of the Ni plating was in a range of not smaller than 3 μm and not larger than 5 μm.

Experiment 2

Next, toner scattering under each condition was evaluated while magnetic forces (peak magnetic forces) and angles (peak positions) of the S2, N2, N3 and S3 poles were adjusted to set different conditions under a condition of the magnetic force difference (Tave-Td) of 15 mT between the N3 and N4 poles after the surface condition of the first sleeve 231B of Experiment 1 was set to (Condition 1) knurled V grooves. Further, the evaluation of toner scattering was judged by toner smear of the housing 23H of the developing device 23. A confirmed place was a wall surface of the housing 23H downstream of the developing position NP in the rotational direction of the photoconductive drum 20 and a degree of smear in a durability test of 10000 sheets was confirmed. Note that the toner smear of the housing 23H was evaluated based on the following criteria and ◎, ○ correspond to levels which are not problematic in actual use.

x: Very smeared

○: Slightly smeared

◎: Hardly smeared

Evaluation results under the above experimental conditions are shown in Tables 4 and 5.

TABLE 4

| EXPERIMENT | PEAK MAGNETIC FORCE OF EACH POLE (mT) S2 | N3 | N4 | S3 | INTER-POLE ANGLE (°) X | Y | E/X | F/Y | E/X−F/Y | TONER SCATTERING EVALUATION |
|---|---|---|---|---|---|---|---|---|---|---|
| 1 | 42 | 39 | 39 | 39 | 40 | 60 | 2.0 | 1.3 | 0.7 | ◎ |
| 2 | 42 | 39 | 39 | 78 | 40 | 60 | 2.0 | 2.0 | 0.1 | ○ |
| 3 | 42 | 39 | 39 | 88 | 40 | 60 | 2.0 | 2.1 | −0.1 | X |
| 4 | 42 | 39 | 39 | 96 | 40 | 60 | 2.0 | 2.3 | −2.0 | X |

TABLE 4-continued

| EXPERIMENT | PEAK MAGNETIC FORCE OF EACH POLE (mT) S2 | N3 | N4 | S3 | INTER-POLE ANGLE (°) X | Y | E/X | F/Y | E/X−F/Y | TONER SCATTERING EVALUATION |
|---|---|---|---|---|---|---|---|---|---|---|
| 5 | 42 | 62 | 61 | 82 | 40 | 60 | 2.6 | 2.4 | 0.2 | ○ |
| 6 | 42 | 62 | 61 | 97 | 40 | 60 | 2.6 | 2.6 | 0.0 | X |
| 7 | 42 | 83 | 79 | 97 | 40 | 60 | 3.1 | 2.9 | 0.2 | ○ |
| 8 | 58 | 40 | 40 | 78 | 40 | 60 | 2.5 | 2.0 | 0.5 | ◎ |
| 9 | 58 | 40 | 40 | 95 | 40 | 60 | 2.5 | 2.3 | 0.2 | ○ |
| 10 | 58 | 61 | 61 | 97 | 40 | 60 | 3.0 | 2.6 | 0.3 | ○ |
| 11 | 60 | 81 | 81 | 80 | 40 | 60 | 3.5 | 2.7 | 0.8 | ◎ |
| 12 | 60 | 81 | 81 | 94 | 40 | 60 | 3.5 | 2.9 | 0.6 | ○ |
| 13 | 82 | 40 | 40 | 97 | 40 | 60 | 3.1 | 2.3 | 0.8 | ◎ |
| 14 | 82 | 59 | 59 | 98 | 40 | 60 | 3.5 | 2.6 | 0.9 | ◎ |
| 15 | 82 | 80 | 80 | 80 | 40 | 60 | 4.1 | 2.7 | 1.4 | ◎ |
| 16 | 82 | 80 | 80 | 95 | 40 | 60 | 4.1 | 2.9 | 1.1 | ◎ |
| 17 | 41 | 43 | 43 | 39 | 50 | 50 | 1.7 | 1.6 | 0.0 | ○ |
| 18 | 41 | 43 | 43 | 60 | 50 | 50 | 1.7 | 1.6 | −0.4 | X |
| 19 | 41 | 62 | 62 | 38 | 50 | 50 | 2.1 | 2.0 | 0.1 | ○ |
| 20 | 41 | 62 | 62 | 61 | 50 | 50 | 2.1 | 2.5 | −0.4 | X |
| 21 | 41 | 82 | 82 | 40 | 50 | 50 | 2.5 | 2.4 | 0.0 | ○ |
| 22 | 41 | 82 | 82 | 60 | 50 | 50 | 2.5 | 2.8 | −0.4 | X |
| 23 | 60 | 40 | 40 | 45 | 50 | 50 | 2.0 | 1.7 | 0.3 | ○ |
| 24 | 60 | 40 | 40 | 59 | 50 | 50 | 2.0 | 2.0 | 0.0 | ○ |
| 25 | 60 | 40 | 40 | 78 | 50 | 50 | 2.0 | 2.4 | −0.4 | X |
| 26 | 60 | 61 | 61 | 40 | 50 | 50 | 2.4 | 2.0 | 0.4 | ○ |
| 27 | 60 | 61 | 61 | 60 | 50 | 50 | 2.4 | 2.4 | 0.0 | ○ |
| 28 | 60 | 61 | 61 | 80 | 50 | 50 | 2.4 | 2.8 | −0.4 | X |
| 29 | 60 | 61 | 61 | 100 | 50 | 50 | 2.4 | 3.2 | −0.8 | X |
| 30 | 60 | 78 | 78 | 60 | 50 | 50 | 2.8 | 2.8 | 0.0 | ○ |
| 31 | 60 | 78 | 78 | 80 | 50 | 50 | 2.8 | 3.2 | −0.4 | X |
| 32 | 80 | 39 | 39 | 60 | 50 | 50 | 2.4 | 2.0 | 0.4 | ○ |
| 33 | 80 | 39 | 39 | 80 | 50 | 50 | 2.4 | 2.4 | 0.0 | ○ |
| 34 | 80 | 39 | 39 | 100 | 50 | 50 | 2.4 | 2.8 | −0.4 | X |
| 35 | 80 | 59 | 59 | 60 | 50 | 50 | 2.8 | 2.4 | 0.4 | ○ |

TABLE 5

| EXPERIMENT | PEAK MAGNETIC FORCE OF EACH POLE (mT) S2 | N3 | N4 | S3 | INTER-POLE ANGLE (°) X | Y | E/X | F/Y | E/X−F/Y | TONER SCATTERING EVALUATION |
|---|---|---|---|---|---|---|---|---|---|---|
| 36 | 80 | 59 | 59 | 80 | 50 | 50 | 2.8 | 2.8 | 0.0 | ○ |
| 37 | 80 | 59 | 59 | 95 | 50 | 50 | 2.8 | 3.1 | −0.3 | X |
| 39 | 80 | 82 | 82 | 60 | 50 | 50 | 3.2 | 2.8 | 0.4 | ○ |
| 40 | 80 | 82 | 82 | 78 | 50 | 50 | 3.2 | 3.2 | 0.0 | ○ |
| 41 | 80 | 82 | 82 | 95 | 50 | 50 | 3.2 | 3.5 | −0.3 | X |
| 42 | 40 | 40 | 40 | 38 | 60 | 40 | 1.3 | 2.0 | −0.6 | X |
| 43 | 40 | 60 | 60 | 39 | 60 | 40 | 1.7 | 2.5 | −0.8 | X |
| 44 | 63 | 40 | 40 | 37 | 60 | 40 | 1.7 | 1.9 | −0.2 | X |
| 45 | 63 | 60 | 60 | 39 | 60 | 40 | 2.1 | 2.5 | −0.4 | X |
| 46 | 63 | 60 | 60 | 60 | 60 | 40 | 2.1 | 3.0 | −1.0 | X |
| 47 | 63 | 81 | 81 | 40 | 60 | 40 | 2.4 | 3.0 | −0.6 | X |
| 48 | 82 | 41 | 41 | 38 | 60 | 40 | 2.1 | 2.0 | 0.1 | ○ |
| 49 | 82 | 41 | 41 | 58 | 60 | 40 | 2.1 | 2.5 | −0.4 | X |
| 50 | 82 | 62 | 62 | 38 | 60 | 40 | 2.4 | 2.5 | −0.1 | X |
| 51 | 82 | 81 | 81 | 39 | 60 | 40 | 2.7 | 3.0 | −0.3 | X |
| 52 | 42 | 39 | 58 | 41 | 40 | 60 | 2.0 | 1.7 | 0.4 | ○ |
| 53 | 42 | 80 | 58 | 41 | 40 | 60 | 3.1 | 1.7 | 1.4 | ◎ |
| 54 | 60 | 80 | 61 | 60 | 40 | 60 | 3.5 | 2.0 | 1.5 | ◎ |
| 55 | 60 | 60 | 80 | 60 | 40 | 60 | 3.0 | 2.3 | 0.7 | ◎ |
| 56 | 80 | 60 | 80 | 80 | 40 | 60 | 3.5 | 2.7 | 0.8 | ◎ |
| 57 | 76 | 59 | 81 | 83 | 40 | 60 | 3.4 | 2.7 | 0.6 | ◎ |
| 58 | 41 | 41 | 59 | 42 | 50 | 50 | 1.6 | 2.0 | −0.4 | X |
| 59 | 41 | 80 | 59 | 42 | 50 | 50 | 2.4 | 2.0 | 0.4 | ○ |
| 60 | 60 | 60 | 80 | 60 | 50 | 50 | 2.4 | 2.8 | −0.4 | X |
| 61 | 60 | 80 | 61 | 60 | 50 | 50 | 2.8 | 2.4 | 0.4 | ○ |
| 62 | 80 | 60 | 80 | 80 | 50 | 50 | 2.8 | 3.2 | −0.4 | X |
| 63 | 78 | 59 | 78 | 80 | 50 | 50 | 2.7 | 3.2 | −0.4 | X |

TABLE 5-continued

| EXPERIMENT | PEAK MAGNETIC FORCE OF EACH POLE (mT) S2 | N3 | N4 | S3 | INTER-POLE ANGLE (°) X | Y | E/X | F/Y | E/X−F/Y | TONER SCATTERING EVALUATION |
|---|---|---|---|---|---|---|---|---|---|---|
| 64 | 40 | 80 | 59 | 43 | 60 | 40 | 2.0 | 2.6 | −0.6 | X |
| 65 | 40 | 42 | 59 | 43 | 60 | 40 | 1.4 | 2.6 | −1.2 | X |
| 66 | 60 | 80 | 61 | 60 | 60 | 40 | 2.3 | 3.0 | −0.7 | X |
| 67 | 60 | 60 | 80 | 60 | 60 | 40 | 2.0 | 3.5 | −1.5 | X |
| 68 | 80 | 59 | 76 | 80 | 60 | 40 | 2.3 | 3.9 | −1.6 | X |
| 69 | 80 | 60 | 80 | 80 | 60 | 40 | 2.3 | 4.0 | −1.7 | X |

From the experimental results of Tables 4 and 5, it was found that the retention portion TD of the developer increased and toner scattering was suppressed if the relationship of E/X>F/Y (Equation 2) was satisfied when X (°) denoted the inter-pole angle between the peak position of the N3 pole and that of the S2 pole, Y (°) denoted the inter-pole angle between the peak position of the N4 pole and that of the S3 pole, E (mT) denoted the sum of the peak magnetic force of the N3 pole and that of the S2 pole and F (mT) denoted the sum of the peak magnetic force of the N4 pole and that of the S3 pole in the circumferential distribution of the radial component of the magnetic force of the first magnet 231A. If a relationship of E/X−F/Y>0.5 is satisfied, toner scattering is further suppressed.

Figure 8:
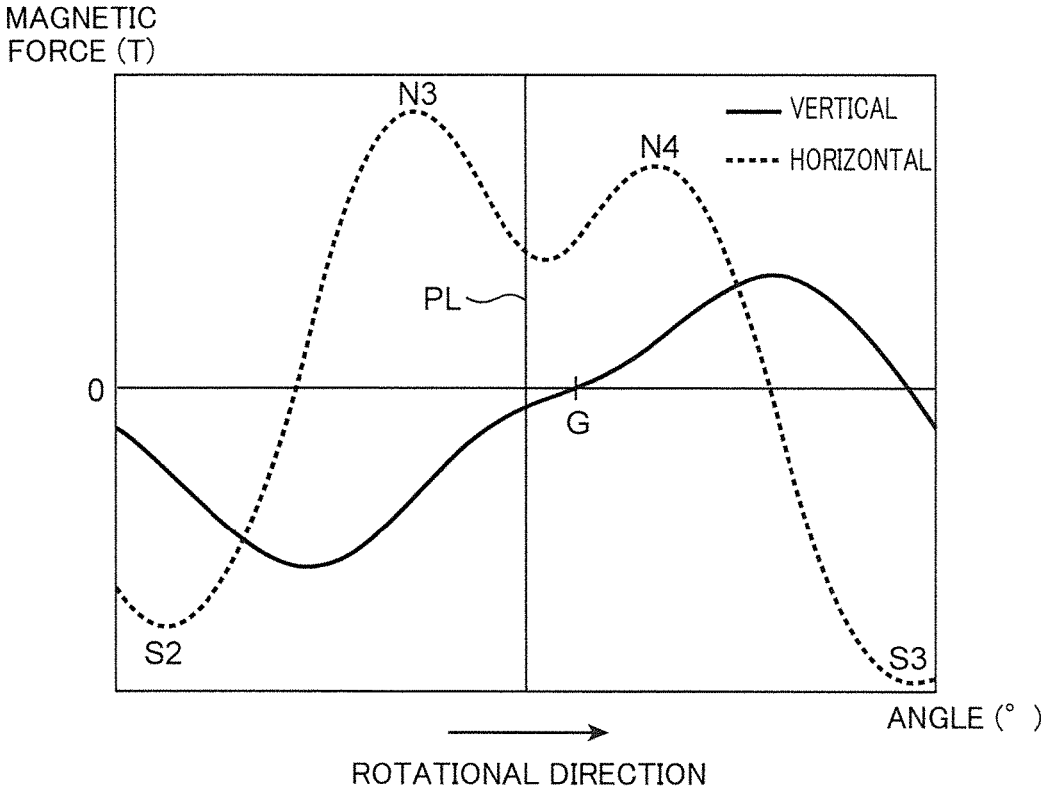
FIG. 8 is a graph showing magnetic force distributions of a radial component (vertical component) and a tangential component (horizontal component) between adjacent poles having the same polarity in the developing roller of the developing device according to a modification of the present disclosure.

Note that FIG. 8 is a graph showing examples of a magnetic force distribution (vertical distribution) of radial components and a magnetic force distribution (horizontal distribution) of tangential components around the N3 and N4 poles of the first magnet 231A when the above Equation 2 was satisfied. A maximum value of a horizontal magnetic force located between the S2 and N3 poles is determined by the sum of the magnetic forces and the angels of the S2 and N3 poles. Further, a maximum value of a horizontal magnetic force located between the N4 and S3 poles is determined by the sum of the magnetic forces and the angels of the N4 and S3 poles. Since the position of the maximum value of the horizontal magnetic force overlaps with a point where a vertical magnetic field becomes 0, a point where the horizontal magnetic force becomes 0 is approximated by a straight line connecting the maximum values of the horizontal forces. In this case, a position G of the point where the horizontal magnetic force becomes 0 is closer to the position where the value of the horizontal magnetic force is lower out of the position of the maximum value of the horizontal magnetic force located between the S2 and N3 poles and the position of the maximum value of the horizontal magnetic force located between the N4 and S3 poles. Thus, if the relationship of Equation 2 is satisfied, the position G of the point where the horizontal magnetic force becomes 0 is located closer to the N4 pole than a middle position PL between the peak of the N3 pole and that of the N4 pole.

Note that when the gap (blade gap) between the layer thickness regulating member 235 and the second sleeve 232B was adjusted and a similar evaluation was conducted with the toner conveyance amount on the first sleeve 231B set in a range of not smaller than 100 g/m$^2$ and not larger than 400 g/m$^2$ in each of Experiments 1 and 2, there was no change in the amount of the developer in the retention portion TD and similar results were obtained concerning the effect of suppressing toner scattering and development ghosts. Further, when an evaluation similar to the above was conducted in a range of the toner density of not lower than 5% and not higher than 12% in each of Experiments 1 and 2, there was no change in the amount of the developer in the retention portion TD and similar results were obtained concerning the effect of suppressing toner scattering and development ghosts. Further, similar results were obtained concerning the effect of suppressing toner scattering and development ghosts also when a similar evaluation was conducted with the diameters of the developing roller 231 and the conveyor roller 232 set in a range of not shorter than 16 mm and not longer than 35 mm and the circumferential speed of the photoconductive drum 20 set in a range of not lower than 200 mm/sec and not higher than 400 mm/sec.

Figure 10:
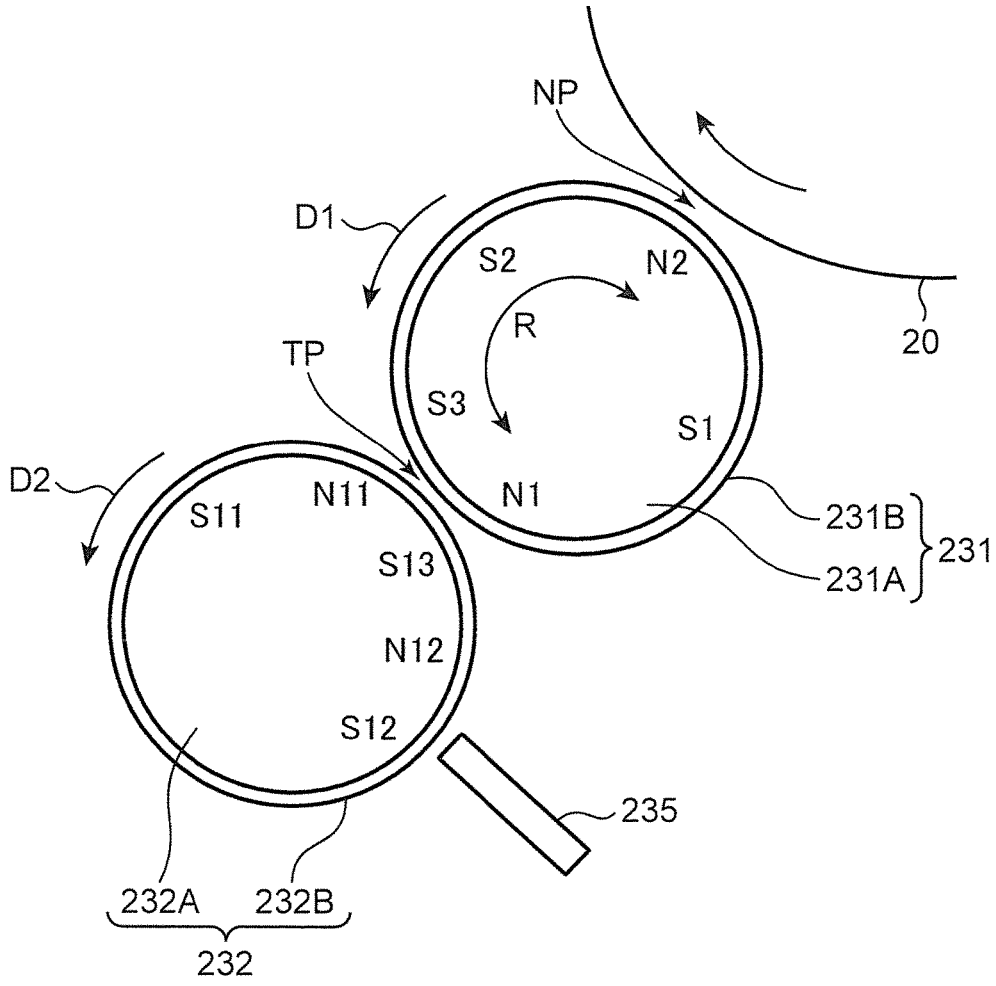
FIG. 10 is a schematic sectional view showing the arrangements of magnetic poles of a developing roller and a conveyor roller according to a second embodiment of the present disclosure.
Figure 11:
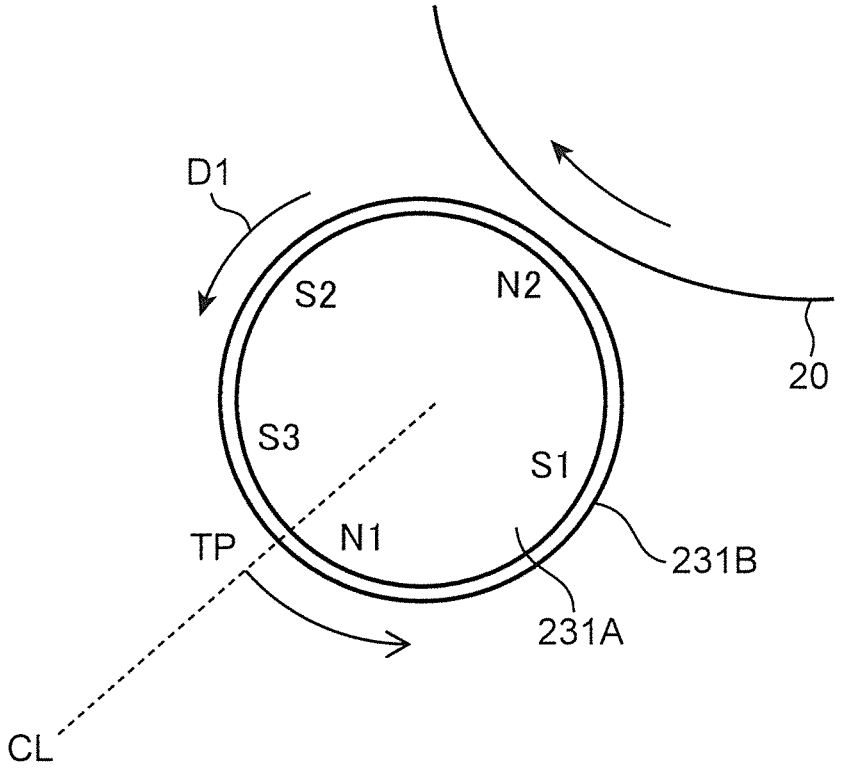
FIG. 11 is a schematic sectional view showing the arrangement of the magnetic poles of the developing roller according to the second embodiment of the present disclosure.
Figure 12:
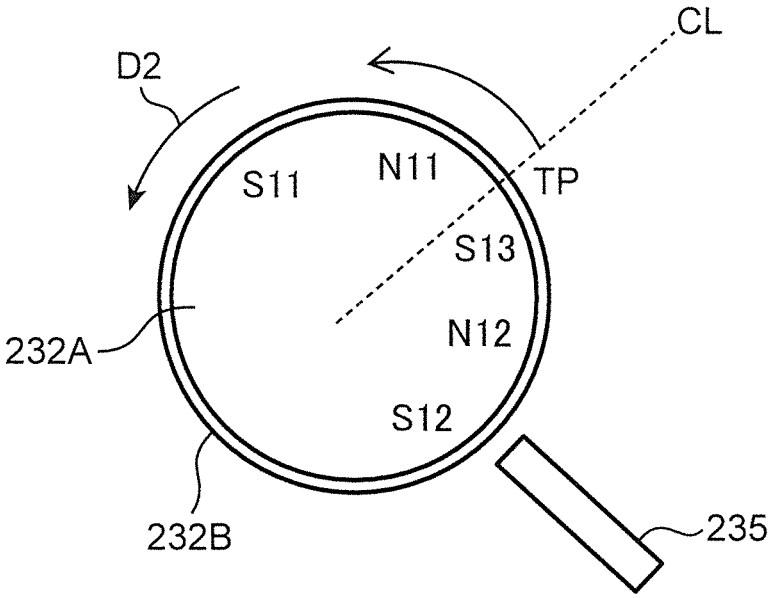
FIG. 12 is a schematic sectional view showing the arrangement of the magnetic poles of the conveyor roller according to the second embodiment of the present disclosure.
Figure 13:
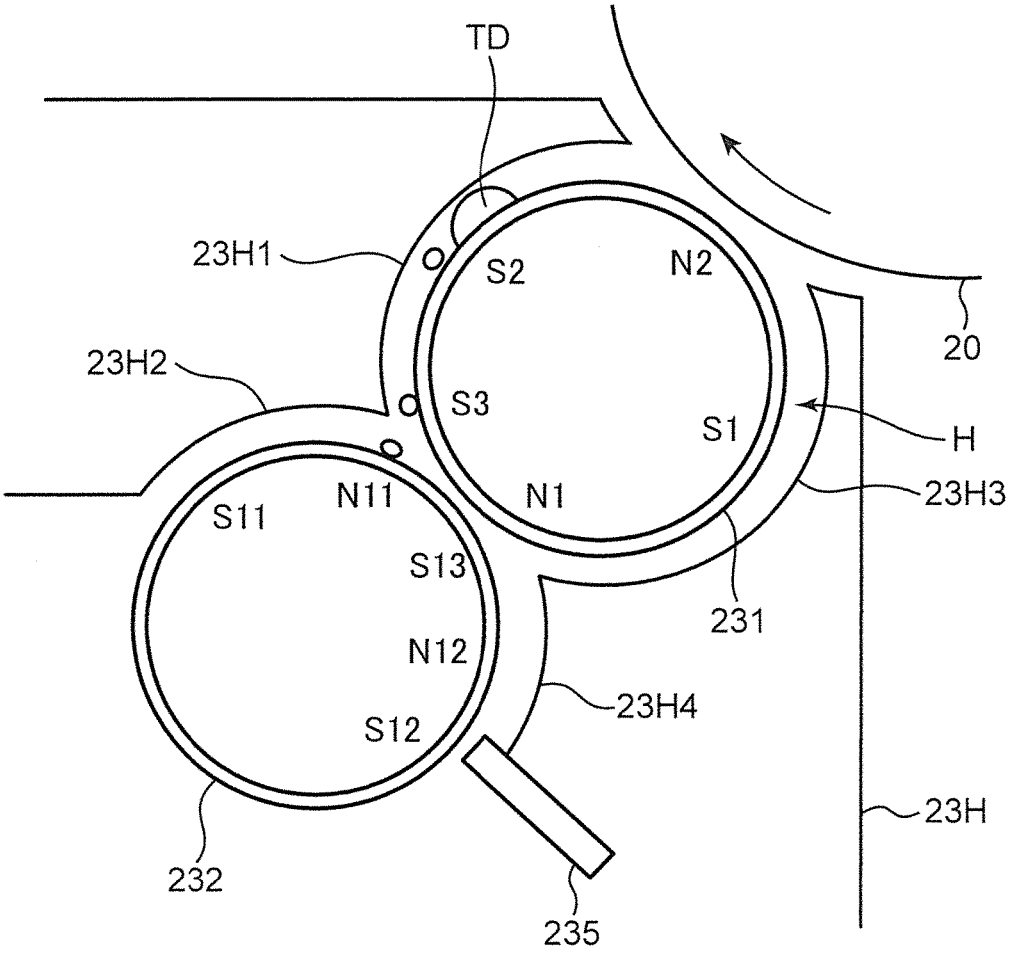
FIG. 13 is a schematic sectional view showing a state where a developer pool is generated in a developing device according to the second embodiment of the present disclosure.

Next, a developing device 23 according to a second embodiment of the present disclosure is described in detail with reference to FIGS. 10 to 13 in addition to FIGS. 1 and 2. Note that, in this embodiment, members having the same functions as in the previous first embodiment are denoted by the same reference signs as in the first embodiment in each figure. FIG. 10 is a schematic sectional view showing the arrangements of magnetic poles of a developing roller 231 and a conveyor roller 232 according to this embodiment. FIG. 11 is a schematic sectional view showing the arrangement of the magnetic poles of the developing roller 231. FIG. 12 is a schematic sectional view showing the arrangement of the magnetic poles of the conveyor roller 232. FIG. 13 is a schematic sectional view showing a state where a developer pool (retention portion TD) is generated in the developing device 23 according to this embodiment. Note that since the configurations of a first magnet 231A of the developing roller 231 and a second magnet 232A of the conveyor roller 232 are different as compared to the previous first embodiment, this embodiment is described, centering on this point of difference.

With reference to FIGS. 10 and 11, the first magnet 231A of the developing roller 231 has five magnetic poles along a circumferential direction in this embodiment. An N1 pole is arranged downstream of a facing position TP between the developing roller 231 and the conveyor roller 232 in a first rotational direction (D1). Further, an S1 pole is arranged downstream of the N1 pole in the first rotational direction. The S1 pole functions as a carrying pole for carrying developer received from the conveyor roller 232 toward a photoconductive drum 20. Further, an N2 pole functioning as a main pole for supplying toner to the photoconductive drum 20 is arranged downstream of the S1 pole in the first rotational direction. The N2 pole is arranged near the developing position NP.

Further, the first magnet 231A has two magnetic poles (S2, S3 poles) in a first region R downstream of the developing position NP in the first rotational direction and upstream of the facing position TP. The S2 pole (first magnetic pole) is arranged substantially in a central part of the first region R. The S3 pole (second magnetic pole) is a magnetic pole arranged downstream of and adjacent to the S2 pole in the first rotational direction and having the same polarity as the S2 pole.

Table 6 shows magnets 3 and 4 with angles and peak magnetic forces of five magnetic poles illustrated as the first magnet 231A according to this embodiment. Note that magnetic forces (peak values of radial components) of some poles of the magnets 3 and 4 differ from each other in magnitude. Further, the angle of each magnetic pole shown in Table 6 is shown along the first rotational direction with the facing position TP of FIG. 11 as a starting point (angle 0°). Note that a straight line CL connecting the facing position TP and a rotation axis center of the developing roller 231 (straight line connecting the rotation axis center of the developing roller 231 and that of the conveyor roller 232) is shown in FIG. 11.

TABLE 6

| MAGNETIC POLE | ANGLE | MAGNET 3 | MAGNET 4 |
|---|---|---|---|
| N1 | 30° | 75 mT | 75 mT |
| S1 | 100° | 70 mT | 70 mT |
| N2 | 160° | 90 mT | 90 mT |
| S2 | 250° | 70 mT | 40 mT |
| S3 | 330° | 40 mT | 40 mT |

On the other hand, with reference to FIGS. 10 and 12, the second magnet 232A of the conveyor roller 232 has five magnetic poles along the circumferential direction. An N11 pole is arranged downstream of the facing position TP between the developing roller 231 and the conveyor roller 232 in a second rotational direction (D2). Further, an S11 pole is arranged downstream of the N11 pole in the second rotational direction. Further, an S12 pole is arranged downstream of the S11 pole in the second rotational direction. The S11 pole functions as a peeling pole for peeling the developer from the conveyor roller 232. The S12 pole functions as a draw-up pole for drawing up the developer from a first screw 233A. An N12 pole and an S13 pole are arranged downstream of the S12 pole in the second rotational direction. As shown in FIG. 12, a layer thickness regulating member 235 described above is arranged to face at a predetermined distance from the second magnet 232A of the conveyor roller 232 between the S12 and N12 poles, and upstream of the S13. Thus, a layer thickness of the developer can be stably regulated before the developer is transferred from the conveyor roller 232 to the developing roller 231. Note that the S13 pole is arranged adjacent to the N11 pole across the facing position TP.

Table 7 shows angles and magnetic forces (peak values of radial components) of five magnetic poles as an example of the second magnet 232A according to this embodiment. The angle of each magnetic pole shown in Table 7 is shown along the second rotational direction with the facing position TP of FIG. 12 as a starting point (angle 0°). Note that a straight line CL connecting the facing position TP and the rotation axis center of the conveyor roller 232 (straight line connecting the rotation axis center of the developing roller 231 and that of the conveyor roller 232) is shown in FIG. 12.

TABLE 7

| MAGNETIC POLE | ANGLE | MAGNETIC FORCE |
|---|---|---|
| N11 | 30° | 70 mT |
| S11 | 91° | 45 mT |
| S12 | 223° | 70 mT |
| N12 | 277° | 45 mT |
| S13 | 330° | 55 mT |

With reference to FIGS. 2 and 10, the arrangements and functions of the magnetic poles of the first magnet 231A of the developing roller 231 and the second magnet 232A of the conveyor roller 232 are further described. The N11 pole (third magnetic pole) of the second magnet 232A is a magnetic pole arranged to face the S3 pole of the first magnet 231A and having a polarity different from the S3 pole. The developer having passed through the developing position NP is transferred from the developing roller 231 to the conveyor roller 232 by a magnetic field formed by the N11 pole and the S3 pole.

Further, the N1 pole (fourth magnetic pole) of the first magnet 231A is a magnetic pole arranged downstream of and adjacent to the S3 pole in the first rotational direction across the facing position TP and having a polarity different from the S3 pole. Furthermore, the S13 pole (fifth magnetic pole) of the second magnet 232A is a magnetic pole upstream of and adjacent to the N11 pole in the second rotational direction across the facing position TP, arranged to face the N1 pole and having a polarity different from the N11 pole. The developer supplied from the first screw 233A of a stirring screw 233 to the conveyor roller 232 is transferred from the conveyor roller 232 to the developing roller 231 by a magnetic field formed by the N1 pole and the S13 pole after being regulated by the layer thickness regulating member 235. Further, the N2 poles (sixth pole) equivalent to a main pole of the developing roller 231 is a magnetic pole upstream of the S2 pole in the first, arranged to face the developing position NP and having a polarity different from the S2 pole.

With reference to FIG. 13, a housing 23H includes a plurality of inner wall portions facing the developing roller 231 and the conveyor roller 232. Specifically, the housing 23H includes a first inner wall portion 23H1, a second inner wall portion 23H2, a third inner wall portion 23H3 and a fourth inner wall portion 23H4. The first inner wall portion 23H1 extends along the peripheral surface of a first sleeve 231B of the developing roller 231 to face the S2 and S3 poles. The second inner wall portion 23H2 is connected to the first inner wall portion 23H1 and extends along the peripheral surface of a second sleeve 232B of the conveyor roller 232 to face the N11 and S11 poles. Similarly, the third inner wall portion 23H3 extends along the peripheral surface of the first sleeve 231B of the developing roller 231 to face the S1 and N1 poles. The first sleeve 231B of the developing roller 231 is arranged to be partially exposed and face the photoconductive drum 20 between the first and third inner wall portions 23H1, 23H3. The fourth inner wall portion 23H4 is connected to the third inner wall portion 23H3 and extends along the peripheral surface of the second sleeve 232B of the conveyor roller 232 to face the S13 and N12 poles. Note that, as shown in FIG. 13, substantially equal clearances H (conveyance path for the developer) are formed between the respective inner wall portions and the first sleeve 231B of the developing roller 231 and the second sleeve 232B of the conveyor roller 232. In this embodiment, heights of these clearances H are smaller than radii of the developing roller 231 and the developing roller 232 and set in a range of 0.5 mm to 2.0 mm.

Also in this embodiment, the forming of toner layer on the developing roller 231, which is one roller facing the photoconductive drum 20, in the developing device 23 in which two magnetic rollers (developing roller 231, conveyor roller 232) and the generation of ghost images as described above are suitably suppressed. Specifically, the developing roller 231 of the developing device 23 has the aforementioned S2 and S3 poles to suppress such ghost images. Thus, even if a history of the toner consumed at the developing position NP remains in the toner layer on the first sleeve 231B, the history of the toner is eliminated (polished) by a magnetic brush of the developer when the developer passes through a repulsive magnetic field formed by adjacent magnetic poles having the same polarity.

Figure 14:
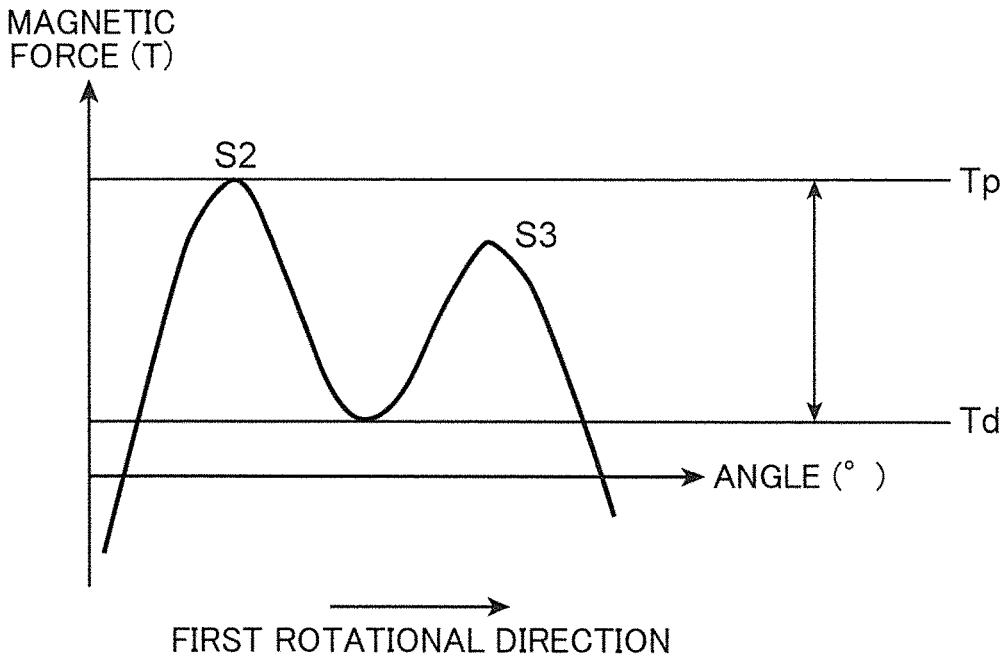
FIG. 14 is a graph showing a magnetic force distribution of a radial component between adjacent poles having the same polarity in the developing roller of the developing device according to the second embodiment of the present disclosure.

FIG. 14 is a graph showing a magnetic force distribution of a radial component between the S2 and S3 poles, which are adjacent magnetic poles having the same polarity, in the developing roller 231 of the developing device 23 according to this embodiment. In this embodiment, a relationship of:

$$Tp-Td \geq 25 \quad \text{(Equation 3)}$$

is satisfied when Tp (mT) denotes a peak magnetic force of the S2 pole and Td (mT) denotes a minimum value of the magnetic force (trough part of the magnetic force) arranged between a peak position of the S2 pole and that of the S3 pole in a circumferential distribution of a radial component of the magnetic force of the first magnet 231A.

By setting a large difference between the peak magnetic force Tp of the S2 pole and the magnetic force Td in the trough part between the S2 and S3 poles in this way, a repulsive magnetic force formed by the S2 and S3 poles increases. In this case, the developer conveyed from the N2 pole to the S2 pole of the developing roller 231 is less likely to move to the S3 pole and, hence, partially retained on the S2 pole as shown in FIG. 13. As a result, the retention portion TD of the developer is formed on the first sleeve 231B of the developing roller 231. In the retention portion TD, the magnetic brush of the developer is retained while slipping on the first sleeve 231B. Thus, even if the history of the toner consumed at the developing position NP remains in the toner layer on the first sleeve 231B, the history of the toner is eliminated (polished) by the magnetic brush of the developer retained in the retention portion TD. Thus, the developing device 23 having the generation of ghosts as described above suppressed is provided. Particularly, when the peak position of the magnetic pole is not present at the facing position TP between the developing roller 231 and the conveyor roller 232 as in this embodiment, a polishing force (scraping force) of the magnetic brush of the developer on the conveyor roller 232 is less likely to reach the surface of the first sleeve 231B. Even in such a case, the retention portion TD can be suitably formed by the repulsive force of the S2 and S3 poles provided in the developing roller 231. Note that such a retention portion TD cannot be sufficiently formed by a known developer peeling pole. By satisfying Equation 3 as described above, the retention portion TD can be formed which can polish the toner layer on the first sleeve 231B. In this embodiment, one developing roller 231 is arranged to face the photoconductive drum 20 and develops an electrostatic latent image on the photoconductive drum 20. Thus, the electrostatic latent image needs to be stably developed at one developing position NP as compared to another developing device in which a plurality of developing rollers are adjacently arranged along the peripheral surface of the photoconductive drum 20. In other words, in the case of arranging the plurality of developing rollers along the rotational direction of the photoconductive drum 20 as described above, a density reduced part of a ghost image formed by the developing roller on an upstream side can be corrected by the developing roller on a downstream side. On the other hand, in this embodiment, if the history of the toner consumption formed on the first sleeve 231B of the developing roller 231 becomes a ghost image during the next rotation, it is difficult to correct. Thus, the next rotation of the history of the toner layer toward the developing position NP can be suitably suppressed by satisfying the above Equation 3. As a result, the complication of the structure of the developing device 23 is suppressed and a cost increase of the developing device 23 is suppressed.

In this embodiment, the S2 and S3 poles are formed of one fan-shaped ferrite magnet. A magnetic force difference between the peak value of the S2 pole and that of the S3 pole is set in a range of 30 mT or less. Within this range, how the retention portion TD is formed can be judged based on the comparison of the peak value Tp of the S2 pole on the upstream side and the magnetic force Td in the trough part. This is because many of magnetic lines of force of the S3 pole extend toward the N11 pole and the magnetic force (peak value) of the S2 pole is dominant in forming the repulsive magnetic force between the S2 and S3 poles since the N11 pole of the conveyor roller 232 is facing the S3 pole on the downstream side. Note that the peak value of the S2 pole is desirably set to be not smaller than the peak value of the S3 pole in order to more stably form the retention portion TD.

With reference to FIG. 13, the overflowing developer without being held by the magnetic force of the S2 pole (excess developer) jumps over the S3 pole and moves to the N11 pole as the amount of the developer in the retention portion TD on the developing roller 231 gradually increases. At this time, the developer is transferred from the developing roller 231 to the conveyor roller 232 by a magnetic field formed by the S3 and N11 poles. The toner in the developer may scatter when the developer jumps in the vicinity of the S3 pole. Thus, focusing on a first region (FIG. 10) of the developing roller 231, a relationship of Equation 4 is desirably satisfied when X)(° denotes an inter-pole angle between a peak position of the N2 pole and that of the S2 pole and Y (mT) denotes the sum of a peak magnetic force of the N2 pole and that of the S2 pole in a circumferential distribution of a radial component of the magnetic force of the first magnet 231A.

$$Y/X > 1.5 \quad \text{(Equation 4)}$$

In Equation 4, a developer holding force formed by the N2 and S2 poles and a predetermined constant (1.5) are specified by an inequality. In this case, the above Equation 4 is easily satisfied when the inter-pole angle between the S2 and N2 poles is smaller and when the sum of the peak magnetic forces is larger in an area on an upstream side in the first rotational direction across the S2 and S3 poles having the same polarity. When the developer holding force on the upstream side in the first rotational direction is large as just described, the retention portion TD of the developer in FIG. 13 is stably formed and more raised. As a result, a top part of the retention portion TD easily contacts the first inner wall portion 23H1 of the housing 23H. In this case, a developer conveyance path is partially closed with the developer of the retention portion TD. Thus, even if the toner scatters in the vicinity of the S3 pole, it is suppressed that this toner reaches the side of the developing position NP. Therefore, the occurrence of toner fogging and toner stain on an image is suppressed. Further, when the relationship of Equation 4 is satisfied, a pressure is applied to the developer of the retention portion TD between the first inner wall portion 23H1 and the first sleeve 231B. Thus, a polishing force for the surface of the first sleeve 231B by the developer of the retention portion TD is increased.

Further, in this embodiment, the developer can be stably transferred from the developing roller 231 to the conveyor roller 232 by arranging the N11 pole having a polarity different from the S3 pole as shown in FIG. 13. At this time, since the first and second inner wall portions 23H1, 23H2 are connected to each other while being formed along the peripheral surfaces of the developing roller 231 and the conveyor roller 232, the developer can be smoothly transferred from the developing roller 231 to the conveyor roller 232. Further, with reference to FIG. 13, an axial center of the developing roller 231 is arranged below that of the photoconductive drum 20 and an axial center of the conveyor roller 232 is arranged below that of the developing roller 231. Thus, coupled with a gravitational action, the developer overflowing from the retention portion TD is stably transferred to the side of the conveyor roller 232 after moving to the S3 pole. Particularly, in this embodiment, the peak position of the S2 pole is arranged downstream in the first rotational direction of a vertically highest top part of the peripheral surface of the developing roller 231. Thus, the developer overflowing from the retention portion TD of the developer in the vicinity of the S2 pole is allowed to smoothly move toward the S3 pole. On the other hand, the developing position NP is arranged upstream in the first rotational direction of the vertically highest top part of the peripheral surface of the developing roller 231. Thus, it is suppressed that the developing operation is obstructed by the developer of the retention portion TD and an image failure occurs at the developing position NP.

Further, in this embodiment, the N1 pole is arranged downstream of the S3 pole in the first rotational direction and the S13 pole is arranged upstream of the N11 pole in the second rotational direction. The developer can be stably supplied from the conveyor roller 232 to the developing roller 231 by a magnetic field formed by the N1 and S13 poles. Thus, developer transfer regions between the developing roller 231 and the conveyor roller 232 are stably formed in different directions in places at opposite sides of the facing position TP. Further, the developer of the retention portion TD having jumped from the S3 pole is less likely to move to the S13 pole. This is because the S13 pole is a magnetic pole having the same polarity as the S3 pole.

Next, the second embodiment of the present disclosure is further described on the basis of examples. Note that the present disclosure is not limited to the following examples.

Experiment 3

Experiment 3 was conducted under the following experimental conditions.

Experimental Conditions

- Photoconductive drum 20: amorphous silicon photoconductor (a-Si) having a diameter ϕ of 30 mm, a surface potential Vo=270 V and a circumferential speed=300 mm/sec
- Gap between layer thickness regulating member 235 and second sleeve 232B: 200 to 600 μm
- Developer conveyance amount (after layer thickness regulation) on developing roller 231: 250 g/m$^2$
- Carrier: a volume average particle diameter of 35 μm, a magnetic force of 80 emu/g
- Toner: a volume average particle diameter of 6.8 μm, a toner density of 7% Conditions of the developing roller 231 used in Experiment 3 are as follows.
- Developing roller 231: a diameter ϕ of 20 mm
- Circumferential speed ratio of the developing roller 231 to photoconductive drum 20: 1.6
- Gap between developing roller 231 and photoconductive drum 20: 300 μm
- Development bias: DC bias=170 V, AC bias=Vpp 1.4 kV, a frequency f of 4.7 kHz, a duty ratio of 50%, rectangular wave (note that a development bias of the conveyor roller 232 also has the same potential)
- Surface conditions of first sleeve 231B:
  - (Condition 1) Knurled V grooves (groove depth of 80 μm, groove width of 0.2 mm, the number of grooves of 120), Ni plating
  - (Condition 2) Sandblasting (Rzjis before plating=8 μm), Ni plating
  - (Condition 3) Sandblasting (Rzjis=8 μm), no plating Further, a magnetic pole distribution of the developing roller 231 used in Experiment 3 is as in the magnets 3 and 4 shown in the previous Table 6. Note that the following magnetic force measurement of the developing roller 231 and the conveyor roller 232 was conducted using a GAUSS METER Model GX-100 produced by Nihon Denji Sokki Co., Ltd.

Further, conditions of the conveyor roller 232 used in Experiment 3 are as follows.

- Conveyor roller 232: a diameter ϕ of 20 mm
- Surface conditions of second sleeve 232B: knurled V grooves (groove depth of 80 μm, groove width of 0.2 mm, the number of grooves of 120)
- Circumferential speed ratio of conveyor roller 232 to developing roller 231: 1.0
- Gap between conveyor roller 232 and developing roller 231: 250 μm Further, a magnetic pole distribution of the conveyor roller 232 used in Experiment 3 is as shown in the previous Table 7.

Experiment 3 was conducted with a relationship of a magnetic force waveform (magnetic force Td in the trough part) between the S2 and S3 poles in two first magnets 231A, i.e. the magnets 3 and 4 of Table 6 changed under the above conditions. Table 8 shows a list of examples and comparative examples of Experiment 3 and evaluation results of development ghosts (ghost images) under the respective conditions.

TABLE 8

| | SLEEVE SURFACE | MAGNETIC FORCE DIFFERENCE | GHOST EVALUATION | |
|---|---|---|---|---|
| EXPERIMENT | PROCESSING | (Tp − Td) | MAGNET 3 | MAGNET 4 |
| COMPARATIVE EXAMPLE 2-1 | KNURLING + Ni PLATING | 20 mT | 2 | 2 |
| EXAMPLE 2-1 | KNURLING + NI PLATING | 25 mT | 3.5 | 3.5 |
| EXAMPLE 2-2 | KNURLING + NI PLATING | 30 mT | 4 | 4 |
| EXAMPLE 2-3 | KNURLING + Ni PLATING | 35 mT | 4 | 4 |
| COMPARATIVE EXAMPLE 2-2 | BLASTING(Rz8 μm) + Ni PLATING | 20 mT | 2 | 2 |
| EXAMPLE 2-4 | BLASTING(Rz8 μm) + Ni PLATING | 25 mT | 4 | 4 |
| EXAMPLE 2-5 | BLASTING(Rz8 μm) + Ni PLATING | 30 mT | 5 | 5 |

TABLE 8-continued

| EXPERIMENT | SLEEVE SURFACE PROCESSING | MAGNETIC FORCE DIFFERENCE (Tp − Td) | GHOST EVALUATION MAGNET 3 | GHOST EVALUATION MAGNET 4 |
|---|---|---|---|---|
| EXAMPLE 2-6 | BLASTING(Rz8 μm) + Ni PLATING | 35 mT | 5 | 5 |
| EXAMPLE 2-7 | BLASTING(Rz8 μm) | 25 mT | 3 | 3 |

In Comparative Example 2-1, a magnetic force difference between Tp and Td was small and the retention portion TD (FIG. 13) of the developer was not sufficiently formed. Thus, development ghosts were generated. Further, in Examples 2-1, 2-2 and 2-3, the magnetic force difference between Tp and Td was sufficient and the conveyance of the developer from the S2 pole to the S3 pole was temporarily obstructed. Thus, the retention portion TD of the developer was sufficiently formed. As a result, the generation of development ghosts was suppressed. On the other hand, in Comparative Example 2-2, conveyance performance of the first sleeve 231B of the developing roller 231 was reduced and the retention portion TD was more easily formed as compared to Comparative Example 2-1, but the magnetic force difference between the Tp and Td was small. Thus, the retention portion TD was not sufficiently formed and development ghosts were generated. In Examples 2-4, 2-5 and 2-6, since the conveyance performance of the first sleeve 231B was reduced as compared to Examples 2-1, 2-2 and 2-3, the retention portion TD of the developer was notably formed and development ghosts were further improved. In Example 2-7, a development ghost suppressing effect was somewhat reduced since no plating was applied to a blasted surface of the first sleeve 231B, but a level was not problematic in actual use. As just described, an effect of suppressing development ghosts is obtained by satisfying the aforementioned relationship of Equation 3.

Note that Conditions 2, 3 of the first sleeve 231B were found to give results similar to the above as a result of conducting a similar evaluation in a range of Rzjis of not smaller than 4 μm and not larger than 14 μm. Further, it was confirmed that there was no difference in the surface roughness Rzjis of the first sleeve 231B before and after plating if a film thickness of the Ni plating was in a range of not smaller than 3 μm and not larger than 5 μm.

Experiment 4

Next, toner scattering under each condition was evaluated while magnetic forces (peak magnetic forces) and angles (peak positions) of the S2 and N2 poles were adjusted to set different conditions under a condition of Tp-Td=25 mT after the surface condition of the first sleeve 231B of Experiment 3 was set to (Condition 1) knurled V grooves. Further, the evaluation of toner scattering was judged by toner smear of the housing 23H of the developing device 23. A confirmed place was a wall surface of the housing 23H downstream of the developing position NP in the rotational direction of the photoconductive drum 20 and a degree of smear in a durability test of 10000 sheets was confirmed. Note that the toner smear of the housing 23H was evaluated based on the following criteria and ◎, ○ correspond to levels which are not problematic in actual use.

x: Very smeared
○: Slightly smeared
◎: Hardly smeared

Evaluation results under the above experimental conditions are shown in Table 9.

TABLE 9

| EXPERIMENT | PEAK MAGNETIC FORCE (mT) N2 | PEAK MAGNETIC FORCE (mT) S2 | INTER-POLE ANGLE X (°) | N2 + S2 Y (mT) | Y/X | EVALUATION TONER SCATTERING | EVALUATION CONVEYANCE FAILURE |
|---|---|---|---|---|---|---|---|
| 1 | 41 | 43 | 104 | 84 | 0.8 | X | ○ |
| 2 | 41 | 43 | 91 | 84 | 0.9 | X | ○ |
| 3 | 40 | 43 | 76 | 83 | 1.1 | X | ○ |
| 4 | 42 | 44 | 57 | 86 | 1.5 | ○ | ○ |
| 5 | 40 | 43 | 41 | 83 | 2.0 | ◎ | ○ |
| 6 | 40 | 62 | 99 | 102 | 1.0 | X | ○ |
| 7 | 42 | 62 | 89 | 104 | 1.2 | X | ○ |
| 8 | 40 | 62 | 62 | 102 | 1.6 | ○ | ○ |
| 9 | 41 | 64 | 39 | 105 | 2.7 | ○ | ○ |
| 10 | 39 | 89 | 102 | 128 | 1.3 | X | ○ |
| 11 | 39 | 89 | 88 | 128 | 1.5 | ○ | ○ |
| 12 | 38 | 89 | 73 | 127 | 1.7 | ○ | ○ |
| 13 | 39 | 89 | 58 | 128 | 2.2 | ◎ | ○ |
| 14 | 39 | 89 | 39 | 128 | 3.3 | ◎ | ○ |
| 15 | 39 | 105 | 39 | 144 | 3.7 | ◎ | ○ |
| 16 | 60 | 37 | 103 | 97 | 0.9 | X | ○ |
| 17 | 63 | 39 | 92 | 102 | 1.1 | X | ○ |
| 18 | 64 | 41 | 77 | 105 | 1.4 | X | ○ |
| 19 | 64 | 41 | 62 | 105 | 1.7 | ○ | ○ |
| 20 | 65 | 41 | 42 | 106 | 2.5 | ◎ | ○ |
| 21 | 66 | 64 | 100 | 130 | 1.3 | X | ○ |
| 22 | 66 | 64 | 90 | 130 | 1.4 | X | ○ |
| 23 | 66 | 66 | 75 | 132 | 1.8 | ○ | ○ |
| 24 | 67 | 67 | 62 | 134 | 2.2 | ◎ | ○ |
| 25 | 63 | 91 | 99 | 154 | 1.6 | ○ | ○ |
| 26 | 64 | 89 | 74 | 153 | 2.1 | ◎ | ○ |
| 27 | 88 | 39 | 100 | 127 | 1.3 | X | ○ |
| 28 | 88 | 39 | 90 | 127 | 1.4 | X | ○ |
| 29 | 88 | 42 | 74 | 130 | 1.8 | ○ | ○ |
| 30 | 89 | 42 | 62 | 131 | 2.1 | ◎ | ○ |
| 31 | 91 | 65 | 98 | 156 | 1.6 | ○ | ○ |
| 32 | 92 | 65 | 75 | 157 | 2.1 | ◎ | ○ |
| 33 | 93 | 65 | 40 | 158 | 4.0 | ○ | ○ |
| 34 | 93 | 65 | 98 | 158 | 1.6 | ○ | ○ |
| 35 | 95 | 100 | 38 | 195 | 5.1 | ◎ | ○ |
| 36 | 110 | 99 | 40 | 209 | 5.2 | ◎ | X |
| 37 | 92 | 90 | 89 | 182 | 2.0 | ◎ | ○ |

From the experimental results of Table 9, it was found that the retention portion TD of the developer increased and toner scattering was suppressed if the relationship of Y/X 1.5 (Equation 4) was satisfied when X (°) denoted the inter-pole angle between the peak position of the N2 pole and that of the S2 pole and Y denoted the sum of the peak magnetic force of the N2 pole and that of the S2 pole in the circumferential distribution of the radial component of the magnetic force of the first magnet 231A. Toner scattering is further suppressed if a relationship of Y/X≥2.0 is satisfied. Further, within the range of Y/X>5.1, the developer did not enter the housing 23H since the developer holding force between the N2 and S2 poles was too strong (Experiment 36 of Table 9). Thus, it is further desirable to set the range of $Y/X \leq 5.1$.

Note that when the gap (blade gap) between the layer thickness regulating member 235 and the second sleeve 232B was adjusted and a similar evaluation was conducted with the toner conveyance amount on the first sleeve 231B set in a range of not smaller than 100 $g/m^2$ and not larger than 400 $g/m^2$ in each of Experiments 3 and 4, there was no change in the amount of the developer in the retention portion TD and similar results were obtained concerning the effect of suppressing toner scattering and development ghosts. Further, when an evaluation similar to the above was conducted in a range of the toner density of not lower than 5% and not higher than 12% in each of Experiments 3 and 4, there was no change in the amount of the developer in the retention portion TD and similar results were obtained concerning the effect of suppressing toner scattering and development ghosts. Further, similar results were obtained concerning the effect of suppressing toner scattering and development ghosts also when a similar evaluation was conducted with the diameters of the developing roller 231 and the conveyor roller 232 set in a range of not shorter than 16 mm and not longer than 35 mm and the circumferential speed of the photoconductive drum 20 set in a range of not lower than 200 mm/sec and not higher than 400 mm/sec.

Although the developing devices 23 according to the first and second embodiment of the present disclosure and the image forming apparatuses 10 provided with these have been described in detail above, the present disclosure is not limited to this. The present disclosure can be, for example, modified as follows.

(1) Although the N3 and N4 poles are described as two adjacent magnetic poles having the same polarity in the first magnet 231A in the above first embodiment, the present disclosure is not limited to this. Two adjacent magnetic poles having the same polarity may be composed of S poles. In this case, other magnetic poles may be reversed between the S and N poles.

(2) Although the S2 pole is arranged upstream of the N3 pole of the first magnet 231A and the S3 pole is arranged downstream of the N4 pole in the above first embodiment, the present disclosure is not limited to this. In the first region R of FIG. 3, other magnetic poles may be arranged to sandwich the S2, N3, N4 and S3 poles.

(3) Further, although the layer thickness regulating member 235 is arranged to face the conveyor roller 232 in the above first and second embodiments, the present disclosure is not limited to this. The layer thickness regulating member 235 may be arranged to face the vicinity of the S1 pole of the developing roller 231. In this case, the first magnet 231A may additionally have another magnetic pole for carrying the developer.

(4) Although the S2 and S3 poles are two adjacent magnetic poles having the same polarity in the first magnet 231A in the above second embodiment, the present disclosure is not limited to this. Two adjacent magnetic poles having the same polarity may be composed of N poles. In this case, other magnetic poles may be reversed between the S and N poles.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device, comprising:

a developing roller including a fixed first magnet having a plurality of magnetic poles along a circumferential direction and a first sleeve configured to rotate in a first rotational direction around the first magnet and carry developer containing toner and magnetic carrier on a peripheral surface, arranged to face a photoconductive drum, on a surface of which an electrostatic latent image is to be formed, at a predetermined developing position and configured to supply the toner to the photoconductive drum;

a conveyor roller including a fixed second magnet having a plurality of magnetic poles along a circumferential direction and a second sleeve configured to rotate in a second rotational direction around the second magnet and carry the developer on a peripheral surface, arranged to face the developing roller at a predetermined facing position and configured to supply the developer to the developing roller; and a developer stirring unit configured to stir the developer and supply the developer to the conveyor roller;

wherein:

the first and second rotational directions are set to be opposite to each other at the facing position;

the first magnet includes a first area that is downstream of the developing position in the first rotational direction and upstream of the facing position in the first rotational direction, the first area includes:

a first magnetic pole composed of a predetermined magnetic pole;

a second magnetic pole arranged downstream of and adjacent to the first magnetic pole in the first rotational direction and having the same polarity as the first magnetic pole;

a third magnetic pole arranged upstream of and adjacent to the first magnetic pole in the first rotational direction and having a polarity different from the first magnetic pole; and a fourth magnetic pole arranged downstream of and adjacent to the second magnetic pole in the first rotational direction and having a polarity different from the second magnetic pole; and the developer that has passed through the developing position is transferred from the developing roller to the conveyor roller after passing through a repulsive magnetic field formed by the first and second magnetic poles, and a relationship of:

$$Tave - Td \geq 15$$

is satisfied when Tave (milli Tesla) denotes an average value of a peak magnetic field of the first magnetic pole and that of the second magnetic pole and Td (milli Tesla) denotes a minimum value of a magnetic field arranged between a peak position of the first magnetic pole and that of the second magnetic pole in a distribution in the circumferential direction of a radial component of the magnetic field of the first magnet.

2. A developing device according to claim 1, wherein:

the second magnet includes a fifth magnetic pole arranged to face the fourth magnetic pole and having a polarity different from the fourth magnetic pole; and the developer that has passed through the developing position is transferred from the developing roller to the conveyor roller by a magnetic field formed by the fourth and fifth magnetic poles.

3. A developing device according to claim 2, wherein:

the first magnet further includes a sixth magnetic pole arranged downstream of and adjacent to the fourth magnetic pole in the first rotational direction across the facing position and having a polarity different from the fourth magnetic pole;

the second magnet further includes a seventh magnetic pole upstream of and adjacent to the fifth magnetic pole in the second rotational direction across the facing position, arranged to face the sixth magnetic pole and having a polarity different from the fifth magnetic pole; and the developer supplied from the developer stirring unit to the conveyor roller is transferred from the conveyor roller to the developing roller by a magnetic field formed by the sixth and seventh magnetic poles.

4. A developing device according to claim 3, further comprising:

a layer thickness regulating member arranged to face the conveyor roller on a side upstream of the seventh magnetic pole in the second rotational direction and configured to regulate a layer thickness of the developer supplied from the developer stirring unit to the conveyor roller.

5. A developing device according to claim 1, wherein:

a relationship of:

$$E/X>F/Y$$

is satisfied when X(°) denotes an inter-pole angle between a peak position of the first magnetic pole and that of the third magnetic pole, Y(°) denotes an inter-pole angle between a peak position of the second magnetic pole and that of the fourth magnetic pole, E (milli Tesla) denotes the sum of a peak magnetic field of the first magnetic pole and that of the third magnetic pole and F (milli Tesla) denotes the sum of a peak magnetic field of the second magnetic pole and that of the fourth magnetic pole in a distribution in the circumferential direction of a radial component of the magnetic field of the first magnet.

6. A developing device according to claim 1, further comprising a housing configured to rotatably support the developing roller and the conveyor roller, wherein:

the housing includes a first inner wall portion facing the first and second magnetic poles and extending along the peripheral surface of the first sleeve of the developing roller.

7. A developing device according to claim 6, wherein:

the housing further includes a second inner wall portion connected to the first inner wall portion and extending along the peripheral surface of the second sleeve of the conveyor roller.

8. A developing device according to claim 1, wherein:

the first sleeve of the developing roller includes a base member having blasting applied to a surface.

9. A developing device according to claim 8, wherein:

the first sleeve of the developing roller includes a plating layer applied to the surface of the base member.

10. A developing device according to claim 9, wherein:

the toner is nonmagnetic toner and the plating layer is a nickel plating layer.

11. A developing device according to claim 1, wherein:

a peak position of the first magnetic pole is arranged downstream in the first rotational direction of a vertically highest top part of the peripheral surface of the developing roller.

12. A developing device according to claim 1, wherein:

a development bias, in which an alternating-current bias is superimposed on a direct-current bias, is applied to the developing roller.

13. An image forming apparatus, comprising:

a developing device according to claim 1;

the photoconductive drum configured to receive the supply of the toner from the developing device and carry a toner image on the peripheral surface; and a transfer unit configured to transfer the toner image from the photoconductive drum to a sheet.

14. A developing device, comprising:

a developing roller including a fixed first magnet having a plurality of magnetic poles along a circumferential direction and a first sleeve configured to rotate in a first rotational direction around the first magnet and carry developer containing toner and magnetic carrier on a peripheral surface, arranged to face a photoconductive drum, on a surface of which an electrostatic latent image is to be formed, at a predetermined developing position and configured to supply the toner to the photoconductive drum;

a conveyor roller including a fixed second magnet having a plurality of magnetic poles along a circumferential direction and a second sleeve configured to rotate in a second rotational direction around the second magnet and carry the developer on a peripheral surface, arranged to face the developing roller at a predetermined facing position and configured to supply the developer to the developing roller; and a developer stirring unit configured to stir the developer and supply the developer to the conveyor roller;

wherein:

the first and second rotational directions are set to be opposite to each other at the facing position;

the first magnet includes a first area that is downstream of the developing position in the first rotational direction and upstream of the facing position in the first rotational direction, the first area includes:

a first magnetic pole composed of a predetermined magnetic pole;

a second magnetic pole arranged downstream of and adjacent to the first magnetic pole in the first rotational direction and having the same polarity as the first magnetic pole;

the second magnet includes a third magnetic pole arranged to face the second magnetic pole and having a polarity different from the second magnetic pole;

a magnetic field formed by the second and third magnetic poles causes the developer that has passed through the developing position to be transferred from the developing roller to the conveyor roller after passing through a repulsive magnetic field formed by the first and second magnetic poles; and a relationship of:

$$Tp-Td\geq 25$$

is satisfied when Tp (milli Tesla) denotes a peak magnetic field of the first magnetic pole and Td (milli Tesla) denotes a minimum value of a magnetic field arranged between a peak position of the first magnetic pole and that of the second magnetic pole in a distribution in the circumferential direction of a radial component of the magnetic field of the first magnet.

15. A developing device according to claim 14, wherein:

the first magnet includes a fourth magnetic pole arranged downstream of and adjacent to the second magnetic pole in the first rotational direction across the facing position and having a polarity different from the second magnetic pole;

the second magnet includes a fifth magnetic pole upstream of and adjacent to the third magnetic pole in the second rotational direction across the facing position, arranged to face the fourth magnetic pole and having a polarity different from the third magnetic pole; and the developer supplied from the developer stirring unit to the conveyor roller is transferred from the conveyor roller to the developing roller by a magnetic field formed by the fourth and fifth magnetic poles.

16. A developing device according to claim 14, wherein:

the first magnet includes a sixth magnetic pole upstream of the first magnetic pole in the first rotational direction, arranged to face the developing position and having a polarity different from the first magnetic pole; and a relationship of:

$$Y/X \geq 1.5$$

is satisfied when X(°) denotes an inter-pole angle between the peak position of the first magnetic pole and that of the sixth magnetic pole and Y (milli Tesla) denotes the sum of a peak magnetic field of the first magnetic pole and that of the sixth magnetic pole in the distribution in the circumferential direction of the radial component of the magnetic field of the first magnet.

17. A developing device according to claim 15, further comprising:

a layer thickness regulating member arranged to face the conveyor roller on a side upstream of the fifth magnetic pole in the second rotational direction and configured to regulate a layer thickness of the developer supplied from the developer stirring unit to the conveyor roller.

18. A developing device, comprising:

a developing roller including a fixed first magnet having a plurality of magnetic poles along a circumferential direction and a first sleeve configured to rotate in a first rotational direction around the first magnet and carry developer containing toner and magnetic carrier on a peripheral surface, arranged to face a photoconductive drum, on a surface of which an electrostatic latent image is to be formed, at a predetermined developing position and configured to supply the toner to the photoconductive drum;

a conveyor roller including a fixed second magnet having a plurality of magnetic poles along a circumferential direction and a second sleeve configured to rotate in a second rotational direction around the second magnet and carry the developer on a peripheral surface, arranged to face the developing roller at a predetermined facing position and configured to supply the developer to the developing roller; and a developer stirring unit configured to stir the developer and supply the developer to the conveyor roller;

wherein:

the first and second rotational directions are set to be opposite to each other at the facing position;

the first magnet includes a first area that is downstream of the developing position in the first rotational direction and upstream of the facing position in the first rotational direction the first area includes:

a first magnetic pole composed of a predetermined magnetic pole; and a second magnetic pole arranged downstream of and adjacent to the first magnetic pole in the first rotational direction and having the same polarity as the first magnetic pole; and the developer that has passed through the developing position is transferred from the developing roller to the conveyor roller after passing through a repulsive magnetic field formed by the first and second magnetic poles, wherein:

an axial center of the developing roller is arranged below that of the photoconductive drum; and an axial center of the conveyor roller is arranged below that of the developing roller.

19. A developing device, comprising:

a developing roller including a fixed first magnet having a plurality of magnetic poles along a circumferential direction and a first sleeve configured to rotate in a first rotational direction around the first magnet and carry developer containing toner and magnetic carrier on a peripheral surface, arranged to face a photoconductive drum, on a surface of which an electrostatic latent image is to be formed, at a predetermined developing position and configured to supply the toner to the photoconductive drum;

a conveyor roller including a fixed second magnet having a plurality of magnetic poles along a circumferential direction and a second sleeve configured to rotate in a second rotational direction around the second magnet and carry the developer on a peripheral surface, arranged to face the developing roller at a predetermined facing position and configured to supply the developer to the developing roller; and a developer stirring unit configured to stir the developer and supply the developer to the conveyor roller;

wherein:

the first and second rotational directions are set to be opposite to each other at the facing position;

the first magnet includes a first area that is downstream of the developing position in the first rotational direction and upstream of the facing position in the first rotational direction, the first area includes:

a first magnetic pole composed of a predetermined magnetic pole; and a second magnetic pole arranged downstream of and adjacent to the first magnetic pole in the first rotational direction and having the same polarity as the first magnetic pole; and the developer that has passed through the developing position is transferred from the developing roller to the conveyor roller after passing through a repulsive magnetic field formed by the first and second magnetic poles, wherein:

the developing position is arranged upstream in the first rotational direction of a vertically highest top part of the peripheral surface of the developing roller.

* * * * *